US008430398B2

(12) United States Patent
Kamichi

(10) Patent No.: US 8,430,398 B2
(45) Date of Patent: Apr. 30, 2013

(54) SHEET POSITIONING DEVICE, SHEET STACKER, IMAGE FORMING APPARATUS, AND IMAGE SCANNER

(75) Inventor: Jumpei Kamichi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/356,781

(22) Filed: Jan. 24, 2012

(65) Prior Publication Data

US 2012/0187622 A1 Jul. 26, 2012

(30) Foreign Application Priority Data

Jan. 26, 2011 (JP) ..... 2011-013657

(51) Int. Cl.
*B65H 1/00* (2006.01)

(52) U.S. Cl.
USPC ..... 271/171

(58) Field of Classification Search ..... 271/171; 399/370, 376, 377, 379, 389, 393
See application file for complete search history.

(56) References Cited

U.S. PATENT DOCUMENTS

| | | | | |
|---|---|---|---|---|
| 7,059,597 | B2 * | 6/2006 | Shirakura et al. | 271/171 |
| 2010/0221050 | A1 * | 9/2010 | Kobayashi et al. | 399/389 |

FOREIGN PATENT DOCUMENTS

| | | | |
|---|---|---|---|
| JP | 05330669 | A | 12/1993 |
| JP | 06016318 | A | 1/1994 |
| JP | 07267474 | A | 10/1995 |
| JP | 2003128271 | A | 5/2003 |
| JP | 2004299882 | A | 10/2004 |
| JP | 2007297190 | A | 11/2007 |
| JP | 2009040542 | A | 2/2009 |

OTHER PUBLICATIONS

Abstract of JP 07-267474 published Oct. 17, 1995.
Abstract of JP 2009-040542 published Feb. 26, 2009.
Abstract of JP 2004-299882 published Oct. 28, 2004.
Abstract of JP 2003-128271 published May 8, 2003.
Abstract of JP 05-330669 published Dec. 14, 1993.
Abstract of JP 06-016318 published Jan. 25, 1994.
Abstract of JP 2007-297190 published Nov. 15, 2007.

* cited by examiner

*Primary Examiner* — David H Bollinger
(74) *Attorney, Agent, or Firm* — Harness, Dickey & Pierce, P.L.C.

(57) ABSTRACT

A sheet positioning device includes a platen on which to place a sheet of recording media, a first and second regulation members disposed on the platen and movable along the platen, a drive source, a drive transmitter to transmit a drive force generated by the drive source to the first and second regulation members, and a sheet sensor unit. The sheet sensor unit includes a plurality of sheet detection levers, a biasing member, and a connecting member that connects the plurality of sheet detection levers so that the entire sheet sensor unit moves as a single unit between first and second positions reciprocally to detect the sheet on the platen according to the position of the sheet detection levers moving from the first position being biased by the biasing member to the second position in contact with the sheet placed on the platen.

20 Claims, 20 Drawing Sheets

SHEET POSITIONING DEVICE, SHEET STACKER, IMAGE FORMING APPARATUS, AND IMAGE SCANNER

CROSS-REFERENCE TO RELATED APPLICATION

The present application claims priority from Japanese patent application number 2011-013657, filed on Jan. 26, 2011, the entire contents of which are incorporated by reference herein.

BACKGROUND OF THE INVENTION

1. Field of the Invention

The present invention relates to a sheet positioning device which performs positioning of a sheet member placed on a placement surface or platen, a sheet stacker provided with the sheet positioning device, an image forming apparatus, and an image scanner.

2. Discussion of the Related Art

A sheet positioning device has been incorporated in an image forming apparatus such as a copier and a printer, an image reader such as a scanner, and an automatic document feeder (hereinafter "ADF") which are configured to use a sheet-shaped member. The sheet positioning device serves to align the sheet member such as a recording sheet, an OHP film, or an original sheet at a predetermined position on a platen or placement surface of the sheet. For example, the image forming apparatus in which a sheet stacker such as a sheet feed cassette or a manual sheet feed tray to contain recording sheets is incorporated has been known. In addition, the scanner or the ADF which incorporates a sheet positioning device on an original platen as a sheet placement surface to place the original sheet thereon has been known.

In such a sheet positioning device, the position of the sheet member placed on the sheet platen is regulated by a regulation member, thereby positioning the sheet member. For example, an image forming apparatus disclosed in JP-H07-267474-A includes a sheet positioning device which includes two side fences as regulation members, configured to slidably move back and forth in the direction perpendicular to the sheet conveyance direction on the platen. Home positions of these two side fences are greatly spaced away from each other. When a recording sheet is placed on the platen of the sheet positioning device, two side fences move to the respective home positions by being driven by a driving motor. In this state, when a bundle of sheets is set on the platen, the driving motor drives in such a direction opposite the above case that the two side fences approach each other. Then, either of the side fences contacts the recording sheet positioned to one side in the conveyance perpendicular direction of the sheet bundle and pushes it to a center. Thus, while each of two side fences pushing the sheet positioned to one side toward the center, a distance of the two side fences comes substantially closer to a sheet width of the recording sheet. Accordingly, the plurality of sheets placed on the platen with carelessness can be aligned to the center of the platen.

With such a structure, a sheet detector to detect whether a recording sheet is placed or not on the platen is preferably provided to prevent positional alignment of the side fences from being performed in a case in which the recording sheet is not placed on the platen. As a sheet detector, JP-2007-297190-A discloses a technology to detect a change in the position of a sheet detection lever. Specifically, the sheet detection lever of the sheet detector is configured to swing about a pivot shaft in a predetermined pivot angle. And when the recording sheet is not placed on the platen, the sheet detection lever is engaged to stop at a predetermined pivotally stop position by a biasing force of a spring. Then, in the thus engaged state, a detection target part of the sheet detection lever is detected by a transmissive photosensor. According to this structure, the sheet detector detects that the recording sheet is not placed on the platen. When the user places a recording sheet on the platen, the recording sheet contacts a rib end of the sheet detection lever to cause the sheet detection lever to move from the pivot stop position. Then, the transmissive photosensor does not detect the detection target part of the sheet detection lever. According to this structure, the sheet detector detects that the recording sheet is placed on the platen.

The inventor of the present invention has developed a manual tray including a sheet detector and a sheet positioning device. FIG. 1 is an oblique perspective view of the manual tray under development seen from above. An arrow B in FIG. 1 shows a direction along a surface of the platen of a manual tray 60 and perpendicular to a recording sheet conveyance direction on the platen, that is, the conveyance perpendicular direction. A broken line L1 shows a center line in the conveyance perpendicular direction of the manual tray 60. On the platen surface, a first side fence 611 and a second side fence 612, both being capable of slidably moving in the conveyance perpendicular direction, are disposed. The first side fence 611 regulates one end position of a recording sheet placed on the platen in the conveyance perpendicular direction of the sheet. The second side fence 612 regulates another end position of a recording sheet placed on the platen in the conveyance perpendicular direction of the sheet. These two side fences slidably move to approach the center line L1 with each other or to retract from the center line L1 with each other. In the illustrated state in FIG. 1, two side fences both stop at positions most spaced away from the center line L1 in the movable range thereof. The most spaced-away positions from each other are home positions of these two side fences. Each of the two side fences moves from each home position toward the center line by a distance corresponding to a sheet size in a state in which the recording sheet is placed on the platen, so that the center of the recording sheet in the conveyance perpendicular direction can be adjusted to the position of the center line L1.

Four sheet detectors are disposed at a leading end portion of the manual tray 60. These sheet detectors each include a sheet detection lever 699. Each sheet detection lever 699 is disposed at a positioned at predetermined intervals in the conveyance perpendicular direction as illustrated in FIG. 1, and a lever end which contacts the recording sheet is configured to protrude from a case of the tray directly upward. When the user places a recording sheet on the platen as illustrated in FIG. 2, the recording sheet P contacts any of the four sheet detection levers 699 to cause the contacted sheet detection lever 699 to move inside the case. According to this operation, the sheet detector detects that the recording sheet P is placed on the platen. Because a plurality of sheet detection levers 699 is disposed along the conveyance perpendicular direction, even though the recording sheet P is placed at any position, the existence of the recording sheet P can be detected.

However, this manual tray 60 includes a following disadvantage. Specifically, in a state as illustrated in FIG. 2, two of the four sheet detection levers 699 are moved inside the case due to contacting the recording sheet P. If in this case two side fences 611 and 612 are slidably moved toward the center line L1, as illustrated in FIG. 3, the recording sheet P is caused to be stuck with a side of the sheet detection lever 699 not contacting the recording sheet P and protruding directly upward from the case. Thus, there is a concern that the recording sheet P be folded or the sheet detection lever 699 or any driving system be damaged.

The present invention has been considered to obviate such a disadvantage and provides an optimal sheet positioning device capable of preventing the sheet member fed and adjusted in the conveyance perpendicular direction from being trapped by any movable contacting member such as a sheet detection lever.

BRIEF SUMMARY OF THE INVENTION

The present invention provides a sheet positioning device including: a platen on which to place a sheet; a first regulation member so disposed on the platen as to be movable in a conveyance perpendicular direction along the platen being a perpendicular direction of the sheet conveyance direction on the platen, the first regulation member being configured to contact one end of the sheet in the conveyance perpendicular direction of the sheet placed on the platen and to regulate the one end of the sheet; a second regulation member to regulate the other end of the sheet by contacting the other end of the sheet in the conveyance perpendicular direction; a drive source; and a drive transmitter to transmit a drive force enacted by the drive source to at least the first regulation member among the first and second regulation members, thereby moving the first regulation member in the conveyance perpendicular direction, in which while the first regulation member regulating the one end of the sheet, the second regulation member regulates the other end of the sheet, and the sheet placed on the platen is adjusted to a predetermined position in the conveyance perpendicular direction of the sheet placed on the platen. The sheet positioning device further includes: a sheet sensor unit which includes: a plurality of sheet detection levers reciprocally movable between a first position and a second position; a biasing member; and a connecting member, in which the sheet sensor unit detects presence or absence of the sheet on the platen according to the position of the sheet detection levers moving from the first position to the second position accompanied by a contact with the sheet placed on the platen in a state being biased toward the first position by a biasing member; and the plurality of sheet detection levers disposed along the conveyance perpendicular direction are connected each other via the connecting member so that the sheet sensor unit integrally moves between the first position and the second position reciprocally.

In the above configuration, when the sheet sensor unit detects that the sheet is placed on the platen, all the sheet detection levers are evacuated from the first position to the second position because the levers are integrally formed via the pivotal shaft, thereby preventing the sheet moving in the conveyance perpendicular direction together with the regulation members from being stuck with any of the sheet detection levers.

These and other objects, features, and advantages of the present invention will become apparent upon consideration of the following description of the preferred embodiments of the present invention when taken in conjunction with the accompanying drawings.

DETAILED DESCRIPTION OF THE INVENTION

An embodiment of a copier as an image forming apparatus and an image scanner according to one embodiment of the present invention will now be described.

Figure 4:
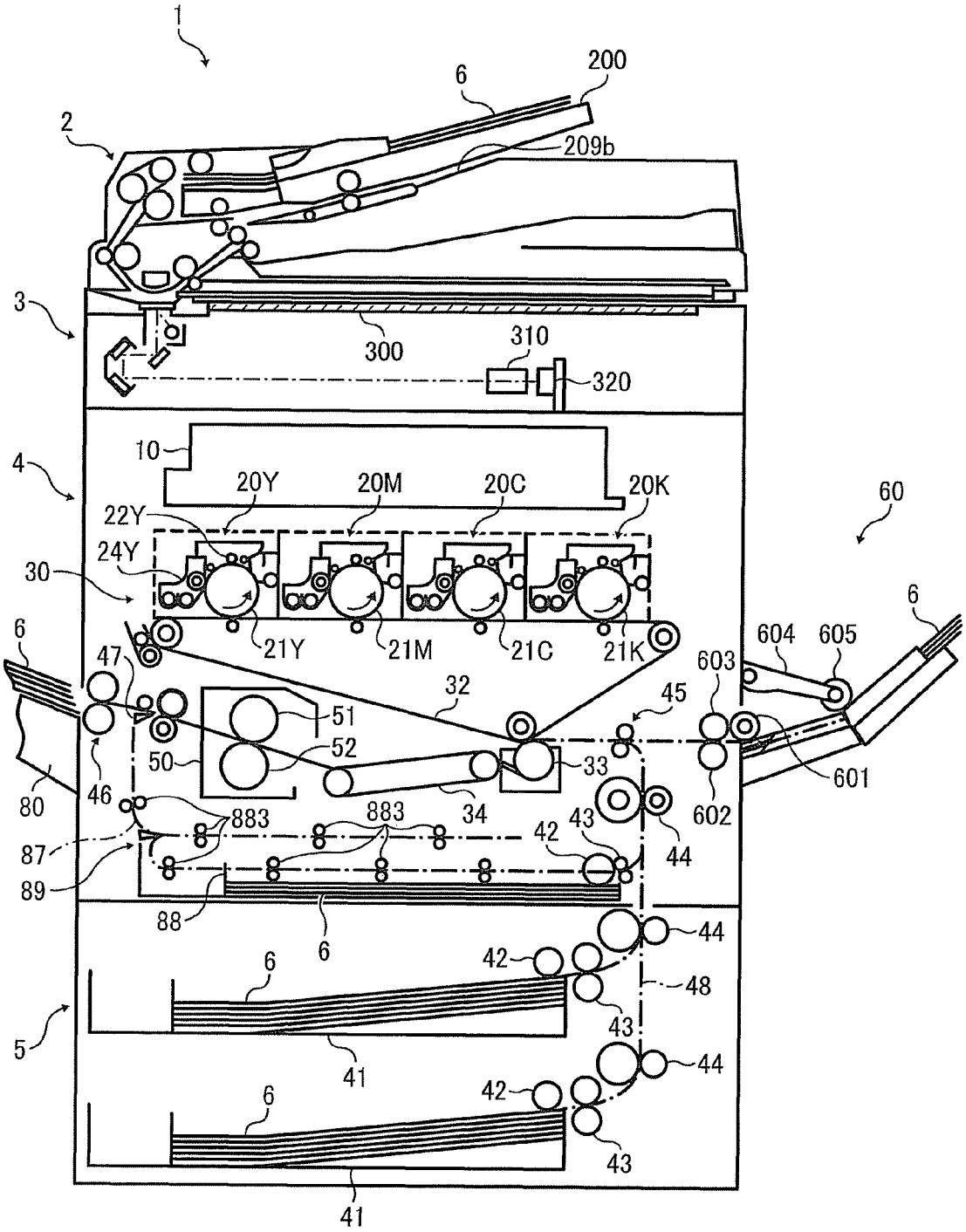
FIG. 4 is a general configuration of a copier according to an embodiment of the present invention.

FIG. 4 is a general configuration of the copier 1 according to one embodiment of the present invention. This copier 1 includes an image forming section which includes an image forming unit 4 and a sheet feeder 5; and an image reader which includes an automatic document feeder (ADF) 2 and a scanner 3.

The sheet feeder 5 of the image forming section includes sheet feed cassettes 41 configured to store a recording sheet 6, a sheet member, on which an image is formed. The image forming unit 4 of the image forming section includes four process cartridges 20Y, 20M, 20C, and 20K to form a toner image of each color of yellow (Y), magenta (M), cyan (C), and black (K); and a transfer device 30. As described above, the image reader includes the scanner 3, which reads an image on an original sheet, and the ADF 2 to automatically convey the original sheet to a reading position of the scanner 3. As illustrated in FIG. 4, the copier according to the embodiment is illustrated from front, and therefore, a near side of the copier in the direction perpendicular to the drawing sheet surface is a front side of the copier, and a depth side of the copier corresponds to a rear side.

There is a transfer device 30 in a substantially vertical, center of the image forming unit 4. This transfer device 30 includes an endless intermediate transfer belt 32 and a plurality of rollers disposed inside loop of the belt. The intermediate transfer belt 32 is stretched over those rollers in the form of a triangle. Each of the support rollers is wound around each of three apexes of the triangle of the intermediate transfer belt 32 at a large angle. Any one of those three support rollers can be a driving roller to endlessly move the intermediate transfer belt 32 in the clockwise direction in FIG. 4.

A belt cleaning device is disposed to contact an outside surface of the loop of the belt at the leftmost support roller in FIG. 4. This belt cleaning device removes residual toner deposited on the surface of the intermediate transfer belt 32 after the belt has passed through a secondary transfer nip that will be described later.

An area of the belt passing through an area extending from contact with the leftmost support roller to contact with the rightmost support roller is substantially horizontally straight. Above the horizontally straight area, four process cartridges 20Y, 20M, 20C, and 20K are sequentially disposed along the belt moving direction. Each of the process cartridges 20Y, 20M, 20C, and 20K is configured to form a toner image of each color of Y, M, C, and K, so as to transfer each color toner image in a superimposed manner on the intermediate transfer belt 32. The copier according to the present embodiment has a so-called tandem type structure in which Y-, M-, C-, and K-toner images are formed in parallel by the process cartridges 20Y, 20M, 20C, and 20K. Meanwhile, in the copier according to the present embodiment, an order of colors is from Y to M, C, and K, but the color order is not limited to this.

In the image forming unit 4, the process cartridges 20Y, 20M, 20C, and 20K each include a drum-shaped photoreceptor 21Y, 21M, 21C, or 21K as an image carrier. Around each photoreceptor, a charger including a charging roller (22Y, 22M, 22C, or 22K), a developing device (24Y, 24M, 24C, or 24K), a photoreceptor cleaning device (23Y, 23M, 23C, or 23K), and a discharger, not shown, are disposed. The charging roller (22Y, 22M, 22C, or 22K) is so disposed as to face each photoreceptor (21Y, 21M, 21C, or 21K), and is applied with primary transfer bias voltage from a power source, not shown in the figure. With such a structure, electrical discharge occurs between each charging roller (22Y, 22M, 22C, or 22K) and each photoreceptor (21Y, 21M, 21C, or 21K), so that the surface of the photoreceptor (21Y, 21M, 21C, or 21K) is uniformly charged. In the copier according to the present embodiment, the surface of the photoreceptor (21Y, 21M, 21C, or 21K) is uniformly charged to a negative polarity, being the same polarity as that of the normally charged polarity of the toner.

Instead of the method of using a charging roller as a charger for the photoreceptor (21Y, 21M, 21C, or 21K), a corona charging method using a wire formed of tungsten or a brush charging method using a conductive brush may be used. In addition, the charger, such as a charging roller, may be disposed to be either in contact with the photoreceptor (21Y, 21M, 21C, or 21K) or non-contacting with the photoreceptor. Use of the non-contacting method has a disadvantage in that a gap between the charging member such as a charging roller and the photoreceptor may cause uneven charging to occur due to the eccentricity of the photoreceptor. However, compared to the contacting method, uneven charging due to the deposition of toner to the charger does not occur easily. As a primary transfer bias to be applied to the charger such as a charging roller, superimposed bias formed by superimposing alternating voltage onto a direct current voltage is preferably used. According to this structure, compared to a case of applying the direct current voltage only, the surface of the photoreceptor can be uniformly charged.

Above the four process cartridges 20Y, 20M, 20C, and 20K, an exposure unit 10 is disposed. A latent image forming unit to form an electrostatic latent image on each photoreceptor 21Y, 21M, 21C, and 21K is formed of the exposure unit 10 and the charging devices for Y, M, C, and K. According to the writing light generated based on image information obtained by reading the image by the scanner 3 or the image information sent from an external PC, the exposure unit 10 optically scans each uniformly charged surface of the photoreceptors 21Y, 21M, 21C, and 21K rotating in the counterclockwise direction in the figure. The exposed surface of the photoreceptors 21Y, 21M, 21C, and 21K has a damped electrical potential than the background portion of the surface not optically exposed. With this structure, the exposed portion carries an electrostatic latent image. The exposure unit 10 may generate a writing beam by a laser diode or an LED array as examples.

The electrostatic latent image for Y, M, C and K carried on each surface of the photoreceptors 21Y, 21M, 21C, and 21K is rendered visible by adhering Y, M, C, and K toner thereon by each of the developing devices 24Y, 24M, 24C, and 24K. The photoreceptors 21Y, 21M, 21C, and 21K contact the intermediate transfer belt 32 to form a primary transfer nip for each color. Primary transfer rollers for Y, M, C, and K each are disposed inside the intermediate transfer belt 32 and backside of the primary transfer nip for Y, M, C, and K. Accordingly, the intermediate transfer belt 32 is sandwiched by the primary transfer rollers for Y, M, C, and K and the photoreceptors 21Y, 21M, 21C, and 21K. Those primary transfer rollers for Y, M, C, and K are supplied with primary transfer bias of positive polarity, being the opposite polarity of the normally charged polarity of the toner. At the primary transfer nip for Y, a Y toner image formed on the photoreceptor 21Y is primarily transferred to an external surface of the intermediate transfer belt 32. The surface of the belt 32 on which a Y toner image is primarily transferred sequentially passes through the primary transfer nip for M, C, and K. During such a process, M, C, and K toner images are sequentially overlaid as a primary transfer to thus form a color toner image on the surface of the belt.

Each surface of the photoreceptors 21Y, 21M, 21C, and 21K after passing through the primary transfer nips for Y, M, C, and K is then cleaned by each of photoreceptor cleaning devices 23Y, 23M, 23C, and 23K and the residual toner is removed therefrom. Thereafter, the photoreceptors are each discharged by a discharger, not shown, and are prepared for next image formation.

At a position where the lowermost support roller is wound over the intermediate transfer belt 32 among the three support rollers disposed inside the loop of the intermediate transfer belt 32, a secondary transfer roller 33 serving as a secondary transfer device contacts the exterior surface of the belt to form a secondary transfer nip. This secondary transfer roller 33 or the lowermost support roller is supplied with secondary transfer bias voltage from a power source, not shown in the figure. Then, a secondary transfer electric field to electrostatically move the color toner image on the intermediate transfer belt 32 toward the secondary transfer roller 33 is formed between the lowermost support roller and the secondary transfer roller 33.

A pair of registration roller 45 each contacting each other and rotating in the forwarding direction while forming a registration nip is disposed at a right side of the secondary transfer nip in FIG. 4. A recording sheet 6 sent from the sheet feeder 5 is sandwiched by the registration nip formed of the registration roller pair 45. Then, the recording sheet 6 is fed by the registration roller pair 45 at timing in sync with the color toner image on the intermediate transfer belt 32. The color toner image on the intermediate transfer belt 32 is secondarily transferred onto the recording sheet 6 by effect of the secondary transfer electric field and nip pressure. The recording sheet 6 on which a color toner image is secondarily transferred is then transferred from the secondary transfer nip to a fixing device 50 via an endlessly moving conveyance belt 34. The fixing device 50 includes a fixing roller 51 serving as a fixing member and a pressure roller 52, both contacting each other to form a fixing nip. The recording sheet 6 is inserted into the fixing nip so that the toner image on the recording sheet 6 is fixed onto it with heat and pressure.

The recording sheet 6 fed from the fixing device 50 comes to a branch point of the conveyance path at which a branching claw 47 is disposed. This branching claw 47 switches over the conveyance path downstream of the branching claw 47 into either a discharge path or a reverse conveyance path 87. When the one-sided print mode is selected as a print operation mode, the branching claw 47 selects the discharge path as a proper conveyance path. When the duplex print mode is selected and the recording sheet 6 sent out from the secondary transfer nip carries toner images on both sides, the branching claw 47 selects the discharge path as a proper conveyance path. The recording sheet 6 that has entered into the discharge path passes through a discharge nip between a discharge roller pair 46 and is discharged outside the apparatus. The recording sheet 6 is then stacked on a sheet discharge tray 80 that is fixed to the external side of the apparatus body.

On the other hand, when the duplex print mode is selected and the recording sheet 6 sent out from the secondary transfer nip carries toner images on the first side only, not on both sides, the branching claw 47 selects the reverse conveyance path 87 as a proper conveyance path. Accordingly, the recording sheet 6 carrying toner images on the first side only when the duplex print mode is selected enters into the reverse conveyance path 87 after having passed through the fixing device 50. The reverse conveyance path 87 includes a reverse conveyance device 89. The reverse conveyance device 89 turns the recording sheet 6, sent out from the fixing device, upside down and temporarily stacks the sheet in a relay tray 88 or resends the sheet to the registration nip between the registration roller pair 45. The recording sheet 6 is returned to the conveyance path by the reverse conveyance device 89, and while the recording sheet 6 passing through the secondary transfer nip again from the registration roller pair 45, toner images are secondarily transferred to the second surface of the recording sheet 6. With this structure, the sheet that has passed through the fixing device 50, the branching claw 47, the sheet discharge path, and the sheet discharge roller pair 46 sequentially is stacked on a sheet discharge tray 80.

When the duplex print mode and the consecutive print mode are concurrently selected, duplex printing is performed to both sides of the plurality of recording sheets 6. In the present copier, the first side printing and the second side printing are performed to the plurality of recording sheets 6 on the block. Namely, when the duplex printing is to be performed to 12 sheets of recording sheets, first, a first recording sheet 6 on which toner images are fixed on the first side is stacked on the relay tray 88 with its face upside down. Next, a second recording sheet 6 on which toner images are fixed on the first side is stacked on the first recording sheet 6 in the relay tray 88 with its face upside down. The above operation is repeated up to the twelfth recording sheet. Now, the first to twelfth recording sheets 6 each on which toner images are fixed on the first side only have been stacked on the relay tray 88. Next, after the twelfth recording sheet 6 is fed out from the relay tray 88 to the conveyance path, toner images are formed on the second side thereof. The recording sheet 6 is discharged on the sheet discharge tray 80. In the similar manner, toner images are printed on the second side of the eleventh to first recording sheets 6 sequentially and each sheet is discharged on the sheet discharge tray 80.

The sheet feeder 5 disposed directly below the image forming unit 4 includes two sheet feed cassettes 41 disposed in a vertical multi-storied manner, a conveyance path 48, and a plurality of conveyance roller pairs 44. The sheet feed cassette 41 as a sheet stacker is detachably attachable to the apparatus body of the sheet feeder 5 by being shifted slidably to a near side from the apparatus body (i.e., in the direction perpendicular to the surface of the drawing sheet). A sheet feed roller 42 supported by a supporter inside the apparatus presses a bundle of the recording sheets disposed inside the sheet feed cassette 41 mounted to the body of the sheet feeder 5. When the sheet feed roller 42 rotates in this state, an uppermost one of the recording sheet 6 in the bundle of the recording sheets is sent toward the conveyance path 48. Before the fed-out recording sheet 6 reaches the conveyance path 48, the recording sheet 6 enters into a separation nip formed by a conveyance roller and a separation roller 43. The conveyance roller rotates in a direction to send the recording sheet 6 from the sheet feed cassette 41 to the conveyance path 48. By contrast, the separation roller 43 rotates in a direction to convey the recording sheet 6 from the conveyance path 48 to the sheet feed cassette 41. A toque limiter is used for drive transmission to transmit the rotary drive force to the separation roller 43. When the separation roller 43 directly contacts the conveyance roller, torque exceeding an upper limit works for the torque limiter. With this structure, the rotary drive force is not transmitted to the separation roller 43 and the separation roller 43 is driven to rotate accompanied by the conveyance roller. When the plural recording sheets 6 in an overlapped manner enter into the separation nip, torque to work for the torque limiter falls below the upper limit due to the occurrence of slippage between sheets. With this structure, the separation roller 43 rotates and reversely conveys a recording sheet 6 that is directly contacts the separation roller 43 among the plural recording sheets 6 toward the sheet feed cassette 41. This reverse conveyance continues until the number of the recording sheets 6 in the conveyance nip reduces to only one and no slippage between sheets occurs. With this structure, the recording sheet 6 is conveyed to the conveyance path 48 in a state being separated to one sheet finally. The recording sheet 6 reaches a registration nip formed by the pair of registration rollers 45 of the image forming unit 4 after having passed through respective conveyance nips formed by the plurality of pairs of conveyance rollers 44.

A manual tray 60 is disposed at and supported by a right side wall of the apparatus body of the image forming unit 4. A manual tray sheet feed roller 601 presses an uppermost sheet of the bundle of the plurality of recording sheets 6 stacked on a platen of the manual tray 60. When the manual sheet feed roller 601 rotates in this state, the uppermost recording sheet 6 is fed out toward the registration roller pair 45. Before the fed-out recording sheet 6 reaches the registration roller pair 45, the recording sheet 6 passes through a separation nip formed by a conveyance roller 603 and a separation roller 602. At this time, the recording sheet P is separated one by one based on the same principle as described in the separation nip disposed at the side of the sheet feed tray 41.

Figure 5:
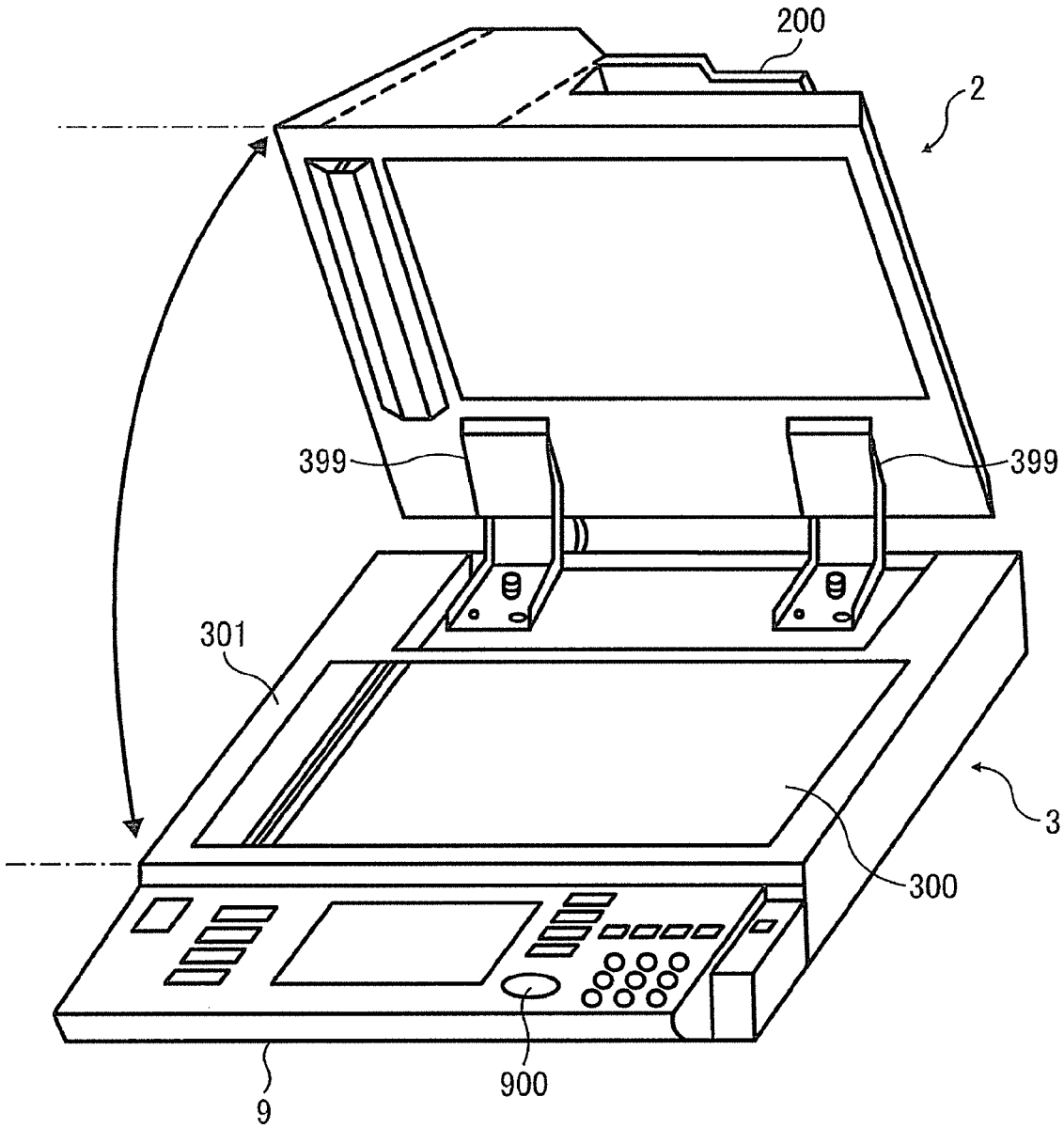
FIG. 5 is an enlarged oblique view illustrating a scanner and an ADF of the copier according to an embodiment of the present invention.

FIG. 5 is an enlarged perspective view of a scanner 3 and an automatic document feeder (ADF) 2 of the copier according to one embodiment of the present invention. As illustrated in FIG. 5, the scanner 3 and the ADF 2 are connected to each other with hinges 399. The ADF 2 is supported by the scanner 3 via the hinges 399 and can move to swing in the directions shown by a double-headed arrow. Due to the swingable movement, the ADF 2 opens so that a first contact glass 300 and a second contact glass 301 both forming an upper surface of the scanner 3 are exposed or closes to move to a position to be laid on right above those contact glasses. In the copier according to the present embodiment, when copying is to be performed to the type of original that cannot be placed on the ADF 2 such as a cardboard or a one-side stapled sheet, to be described later, the ADF 2 is opened to expose an upper surface of the scanner 3 as illustrated in FIG. 5. Then, after an original is placed on the first contact glass 300, the ADF 2 is closed to apply pressure to the original. Then, pressing a copy start button 900 on a control panel 9 fixed to the scanner 3 allows the copier to start copying operation.

Figure 6:
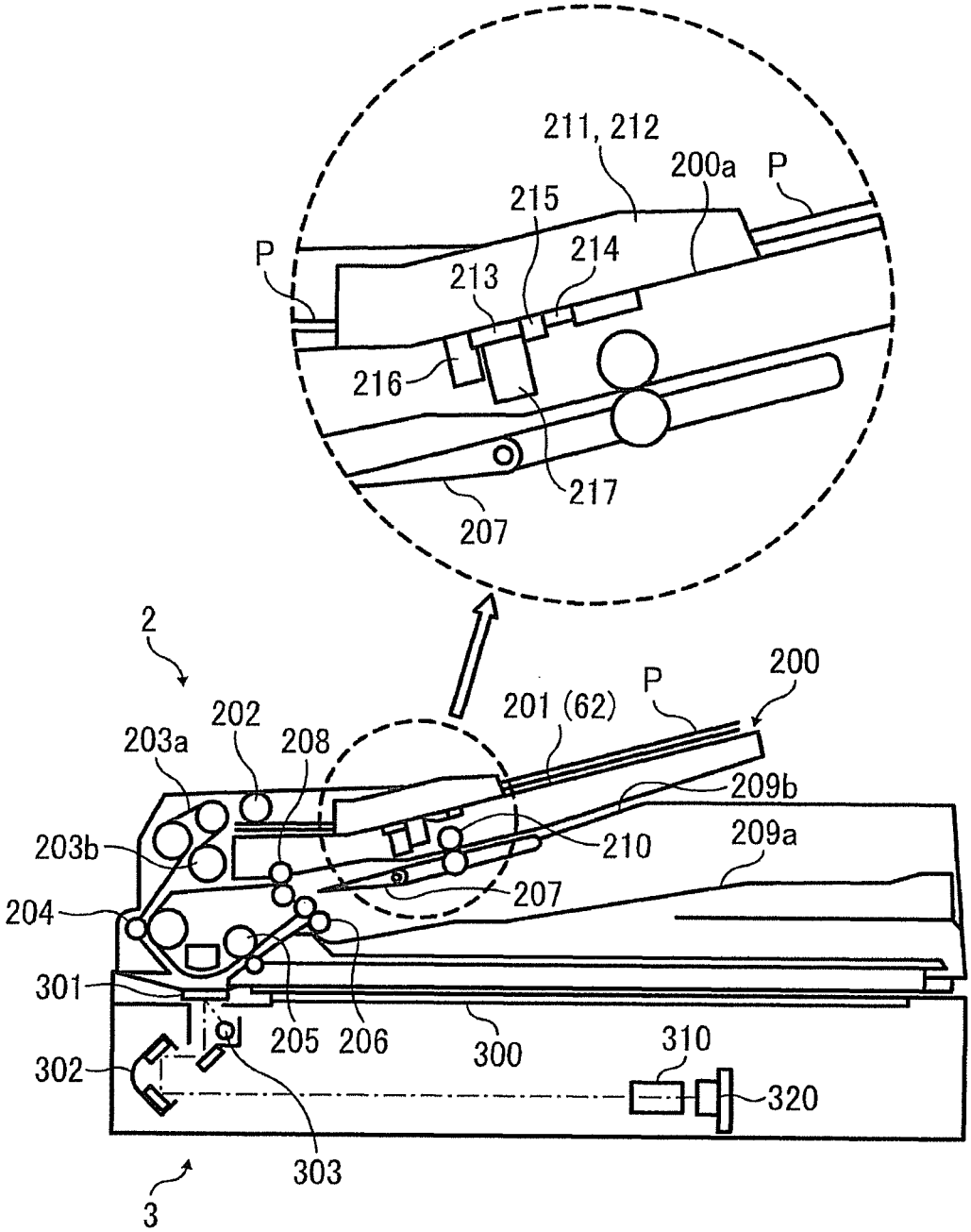
FIG. 6 is an enlarged view illustrating the scanner and the ADF of the copier according to an embodiment of the present invention.

FIG. 6 is an enlarged view of the ADF 2 and the scanner 3. In a case of copying operation of a kind of original sheet P that can be automatically conveyed by the ADF 2, as illustrated in FIG. 6, the ADF 2 is kept closed with respect to the scanner 3 and an original sheet P or a bundle of the original sheets is placed on a tray 200 of the ADF 2. Then, by pressing the copy start button 900, the copier starts copying operation. Copying operation mainly includes an original reading operation by the scanner 3 or an image forming operation by the image forming unit 4. Immediately after the copy start button is pressed, first, an original reading operation starts.

The scanner 3 includes a moving body 302, an imaging lens 310, an image reading sensor 320, and the like, below the first contact glass 300 and the second contact glass 301. The moving body 302 includes a scanning lamp 303 and a plurality of reflective mirrors and moves in a horizontal direction in the figure by a drive mechanism, not shown. Light emitted from the scanning lamp 303 is reflected by an image surface of the original placed on the first contact glass 300 or being conveyed on the second contact glass 301, turning into image reading light. The image reading light is reflected by the plurality of reflective mirrors mounted on the moving body 302, reaches the image reading sensor 320 formed of a Charge Coupled Device (CCD, hereinafter) and the like via the imaging lens fixed to the scanner body, and is focused at a focal point in the sensor 320. With this configuration, an image of the original can be read.

The scanner 3 scans the original placed on the first contact glass 300 while the moving body 302 moving from the position as illustrated in FIG. 6 rightward. With this structure, the image of the original can be read sequentially from the left side area to the right side area in the figure. On the other hand, when the image of the original sheet P placed on the ADF 2 is to be read, with the moving body 302 stopped at the illustrated position, the scanning lamp 303 is lit. The light from the scanning lamp 303 is radiated toward the second contact glass 301. In this case, the ADF 2 starts conveyance of the original sheet P placed on the tray 200 to convey the original sheet P right above the second contact glass 301. According to this, in a state in which the moving body 302 is kept stopped, the image of the original sheet P is sequentially read from the leading end of the sheet to the trailing end of the sheet in the conveyance direction.

The oral sheet P is placed on the tray 200 of the ADF 2 with its scanned side faced upward. A sheet feed roller 202 is disposed on the upper side of the original sheet bundle placed on the tray 200 and is supported to vertically move by a cam mechanism, not shown. When the sheet feed roller 202 is driven to rotate while contacting an uppermost sheet or the original sheet P of the sheet bundle by the vertical move, the original sheet P is fed out from the tray 200. The fed-out original sheet P enters into a separation nip formed by a contact between en endless conveyance belt 203*a* and a reverse roller 203*b*. The conveyance belt 203*a* while being stretched by a driven roller and a drive roller that drives to rotate moves endlessly in the clockwise direction in the figure driven by the normal rotation of the drive roller accompanied by a sheet feed motor, not shown. The reverse roller 203*b* contacts the stretched surface of the conveyance belt 203*a* driven to rotate in the clockwise direction in the figure accompanied by the normal rotation of the sheet feed motor, thereby forming a separation nip. In the separation nip, the surface of the conveyance belt 203*a* moves in the sheet conveyance direction. When the reverse roller 203*b* directly contacts the conveyance belt 203*a* or only one sheet of the original sheet P is sandwiched in the separation nip, the torque limiter works to stop the drive force from the sheet feed motor to the reverse roller 203*b*. With this structure, the reverse roller 203*b* is driven to rotate accompanied by the conveyance belt 203*a* to thus convey the original sheet P in the sheet feed direction. By contrast, when the plural original sheets P in an overlapped manner enter into the separation nip, slippage occurs between sheets, and the torque to work to the torque limiter falls below a threshold value. According to this, the drive force from the sheet feed motor is transmitted to the reverse roller 203*b*, and the reverse roller 203*b* rotates in the clockwise direction in the figure. With this structure, the reverse roller 203*b* rotates and conveys an original sheet P that is directly contacts the reverse roller 203*b* among the plural original sheets P toward the tray 200. This reverse conveyance continues until the number of the original sheets P in the separation nip reduces to only one. With this structure, the original sheet 6 passes through the separation nip in a state being separated to one sheet only finally.

A curved conveyance path which is largely curved in the "C" shape is disposed downstream of the separation nip in the sheet conveyance direction. The original sheet P that has passed through the separation nip is conveyed while being sandwiched between a pair of conveyance rollers 204 disposed in the curved conveyance path and while curving largely along the curved conveyance path. With this structure, the original sheet P is reversed so that the to-be-read surface that has been faced upward is faced downward. Then, the to-be-read surface is held down on the second contact glass 301 of the scanner 3 and passes right above the second contact glass 301, so that the original sheet P is scanned. The original sheet P that has passed right above the second contact glass 301 sequentially passes a first conveyance roller pair 205 and a second conveyance roller pair 206.

A switching claw 207 is disposed swingably about a pivot shaft. When one-side reading mode is selected as a reading operation mode, the switching claw 207 remains stopped as illustrated in FIG. 6. With this posture, the original sheet P that has passed through the second conveyance roller pair 206 after being scanned does not contact the switching claw 207, moves onto a sheet discharge tray 209*a*, and is stacked thereon. By contrast, when a duplex reading mode is selected and one side only of the original sheet P fed out from the second conveyance roller pair 206 is scanned, a flexible end of the switching claw 207 is directed downward than the illustrated figure. Then, the original sheet P that has passed the second conveyance roller pair 206 overrides the switching claw 207 and is sandwiched between rollers of a relay roller pair 210. In this case, the two rollers of the relay roller pair 210 rotates in a direction to cause the original sheet P to be conveyed toward a relay tray 209*b* existing on the right side in FIG. 6. Then, the original sheet P moves to the relay tray 209*b* and rotation driving of the relay roller pair 210 stops immediately before the trailing end of the sheet P passes through the relay roller pair 210. Thereafter, the two rollers of the relay roller pair 210 start to rotate reversely. At the substantially same time, the switching claw 207 returns to the previous position as illustrated in FIG. 6. The original sheet P is switched back as described above and is conveyed to a refeed roller pair 208 disposed substantially right above the second conveyance roller pair 206.

The original sheet P is sandwiched between rollers of the refeed roller pair 208 with its not-scanned surface faced upward. In this state, the original sheet P is conveyed to the curved conveyance path by the rotation driving of the refeed roller pair 208 and passes right above the second contact glass 301 while the to-be-read surface is faced downward, on that the image on the to-be-read surface is read. When the original sheet P of which the other side has been read passes through the second conveyance roller pair 206, the switching claw 207 is kept at the position as illustrated in FIG. 6. The recording sheet P is then stacked on a sheet discharge tray 209*a*.

Next, a description will be given of a structure of the copier according to the present embodiment.

Figure 7:
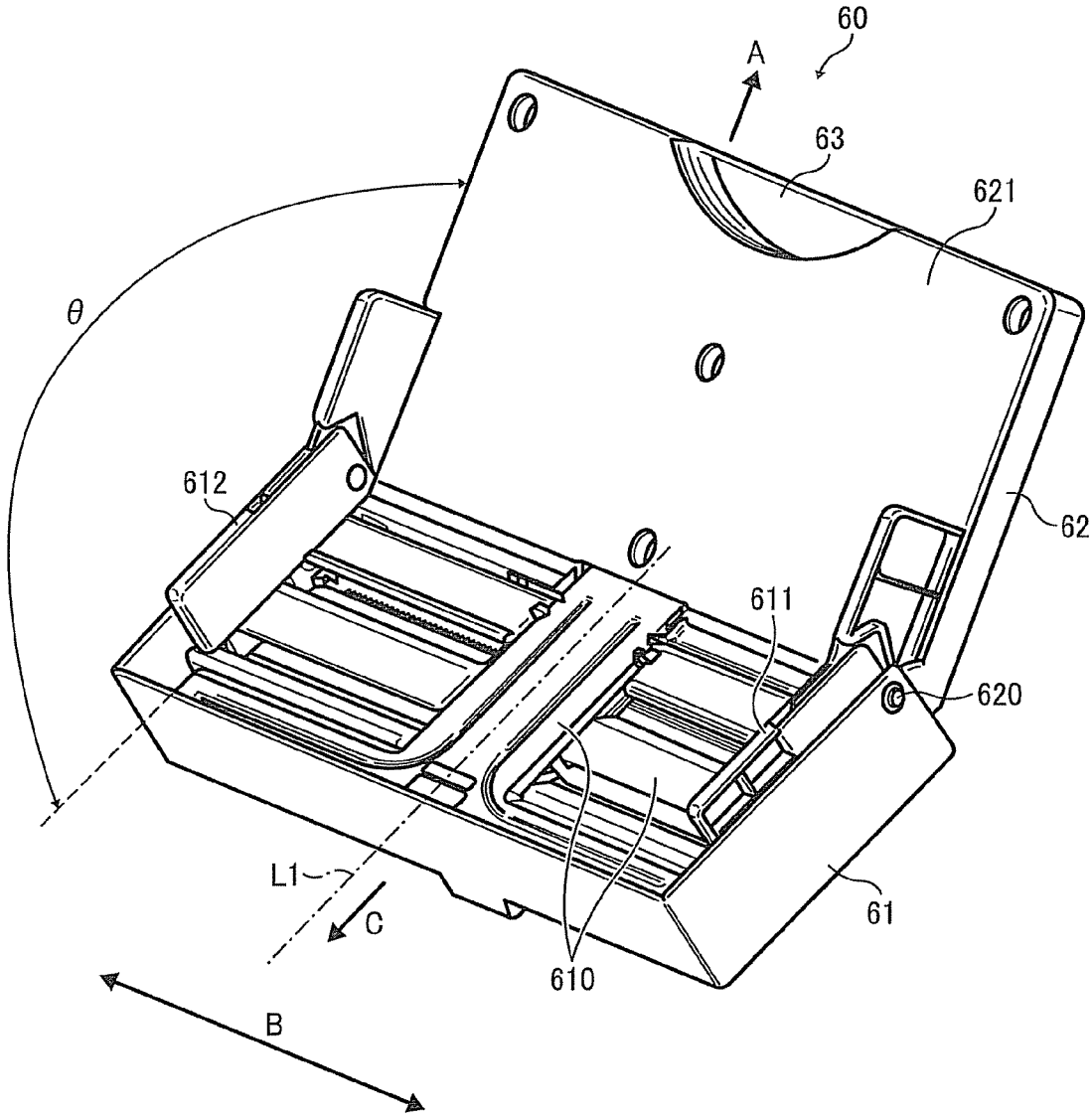
FIG. 7 is an enlarged oblique view illustrating a manual tray of the copier.

FIG. 7 is an enlarged perspective view of the manual tray 60 of the copier according to the present embodiment. As illustrated in FIG. 7, the manual tray 60 includes a first stacker 61 and a second stacker 62. An arrow C in the figure shows a direction in which a recording sheet placed on the manual tray 60 is conveyed from the manual tray 60, i.e., the sheet conveyance direction. The first stacker 61 receives a leading edge side of the recording sheet among an entire area in the conveyance direction of the recording sheet stacked on the manual tray 60. The second stacker 62 receives a trailing edge side of the recording sheet among an entire area in the conveyance direction of the recording sheet stacked on the manual tray 60 and is so supported to the first stacker 61 as to swing within a predetermined range about a pivot shaft. The sheet placement surface of the manual tray 60 is formed of a bottom plate 610 in the first stacker 61 and a sheet receiving surface 621 of the second stacker 62. The sheet placement surface formed of the bottom plate 610 serves as a front side placement surface to receive the leading end of the recording sheet and the sheet receiving surface 621 serves as a distal placement surface to receive the trailing end of the recording sheet.

In FIG. 7, an arrow B shows a conveyance perpendicular direction on the sheet placement surface of the manual tray 60. A broken line L1 shows a center line in the conveyance perpendicular direction of the manual tray 60. The bottom plate 610 of the first stacker 61 includes a slit extending in the arrow B conveyance perpendicular direction. A first side fence 611 and a second side fence 612, both being capable of slidable moving along the slit, are disposed on the bottom plate 610. Those side fences each include a leg portion extending, via the slit, below the bottom plate 610, and each leg portion is supported by a drive transmission unit.

The first side fence 611 as a first regulation member serves to regulate a position of one end of the recording sheet to be placed on the sheet placement surface in the sheet conveyance perpendicular direction. The second side fence 612 as a second regulation member serves to regulate a position of the other end of the recording sheet to be placed on the sheet placement surface in the sheet conveyance perpendicular direction. These two side fences, while extending in the arrow C conveyance direction, slidably move to approach the center line L1 and each other or are retracted from the center line L1 away from each other. In the state illustrated in FIG. 7, two side fences both stop at retracted, home positions spaced a maximum distance away from the center line L1 in the movable range thereof.

A guide container disposed at a rear end portion of the second stacker 62 serves to contain an extension guide 63. The extension guide 63 can be extended from and contained in the guide container. As illustrated in FIG. 7, the extension guide 63 is contained in the second stacker 62. From this state, the extension guide 63 can be pulled out in the direction as shown by an arrow A so that the extension guide 63 can be extended toward the rear of the second stacker 62. When the long recording sheet is to be placed, the extension guide 63 is pulled out to be extended.

Figure 8:
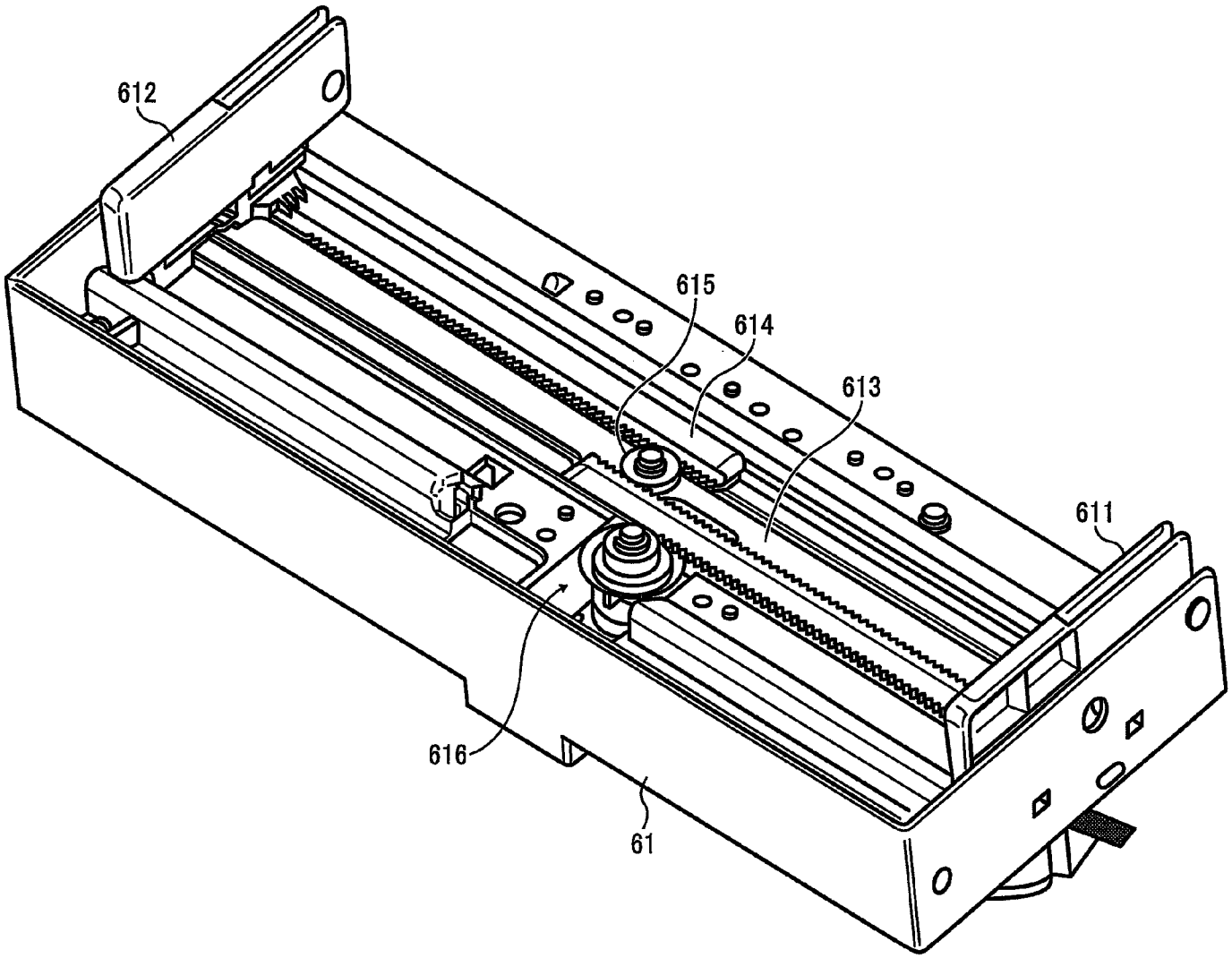
FIG. 8 is an exploded oblique view illustrating a first stacker of the manual tray.

FIG. 8 is an exploded perspective view of the first stacker 61 of the manual tray 60. The same shows the first stacker 61 from which the bottom plate 610 as illustrated in FIG. 7 is removed. The first stacker 61 includes, below the bottom plate, a drive transmission unit including a first rack gear 613; a second rack gear 614; a joint pinion gear 615; and a drive limiter 616. Via the drive transmission unit, drive force of the drive motor is transmitted to the first side fence 611 and the second side fence 612, thereby allowing the fences to slidably move on the bottom plate along the sheet conveyance perpendicular direction.

Figure 9:
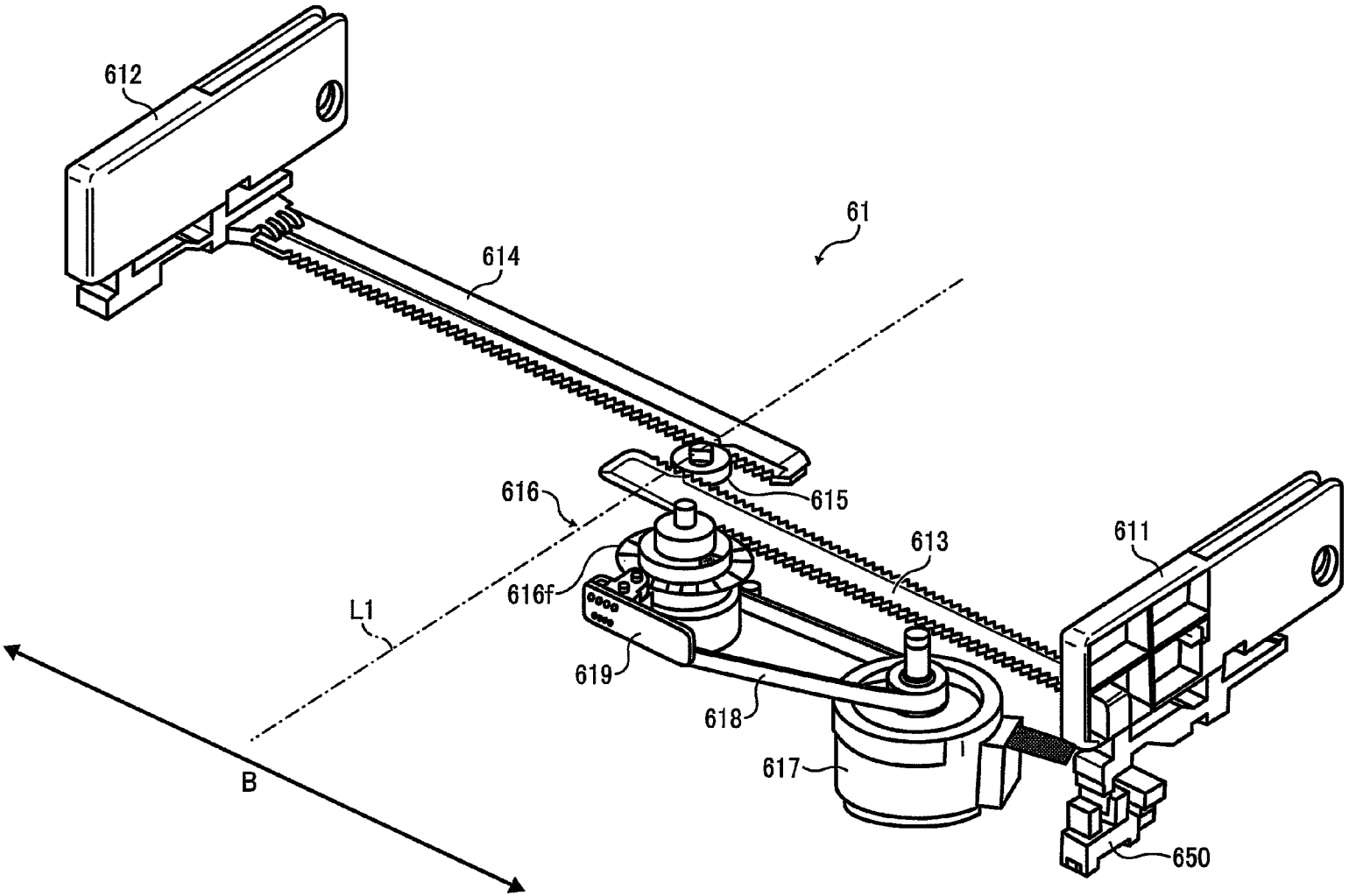
FIG. 9 is an exploded perspective view illustrating a drive transmission unit of the first stacker along with the two side fences.

FIG. 9 is an exploded perspective view illustrating the drive transmission unit of the first stacker 61 along with the two side fences. In FIG. 9, the first rack gear 613 is integrally formed with the leg portion of the first side fence 611 and is supported by the leg portion so as to extend straightly from the leg portion along the conveyance perpendicular direction toward the center line L1 in the arrow B conveyance perpendicular direction of the bottom plate 610 in FIG. 7. Further, the second rack gear 614 is integrally formed with the leg portion of the second side fence 612 and is supported by the leg portion so as to extend straightly from the leg portion along the conveyance perpendicular direction toward the center line L1.

The joint pinion gear 615 has a discotic shape and rotates about its own rotary shaft while being supported by the vertically extending rotary shaft at a position of the center line L1. This joint pinion gear 615 is engaged with the plate-shaped first rack gear 613. Further, among the entire periphery of the joint pinion gear 615, the plate-shaped second rack gear 614 is engaged with the joint pinion gear 615 at an area which is point-symmetric by 180 degrees with respect to the area in which the first rack gear 613 engages with the joint pinion gear 615.

The plate-shaped first rack gear 613 includes two long sides one of which (a first side) is formed with dents with which the joint pinion gear 615 engages. The other side (the second side) of the first rack gear 613 is formed with dents to engage with a gear of a driven drive transmission member of the drive limiter 616, which will be described later. In short, the first rack gear 613 includes dents on the both sides, the dents on the first side engage with the drive source and the dents on the second side engage with the driven member.

A drive motor 617 as a drive source is disposed in the lateral side of the drive limiter 616. An endless timing belt 618 is wound over a motor gear of the drive motor 617. This timing belt 618 is further wound over a timing pulley which will be described later so that the belt 618 is stretched with a predetermined tension. Upon the drive motor 617 driving to rotate in the forward direction, the rotary drive force is transmitted to the timing belt 618 and the drive limiter 616. The rotary drive force is then transformed into the force in the conveyance perpendicular direction at an engagement portion between the gear of the driven transmission member of the drive limiter 616 and the first rack gear 613. Then, the first side fence 611 integrally formed with the first rack gear 613 slidably moves from the illustrated position to the center line L1. At the same time, the force in the conveyance perpendicular direction of the first side fence 611 is transformed into the force in the rotary direction at an engagement portion between the first side fence 611 and the joint pinion gear 615. This rotary force is transformed into the force in the conveyance perpendicular direction at an engagement portion between the joint pinion gear 615 and the second rack gear 614. Then, the second side fence 612 integrally formed with the second rack gear 614 slidably moves from the illustrated position straight to the center line L1.

When the drive motor 617 drives to rotate in the reverse direction, the rotary drive force is transmitted sequentially to the timing belt 618 and the drive limiter 616. Then, the first side fence 611 slidably moves from the side of the center line L1 to one end (at which the first side fence 611 has been positioned in the illustrated figure) in the conveyance perpendicular direction. At the same time, the first rack gear 613 integrally formed with the first side fence 611 slidably moves straight while allowing the joint pinion gear 615 to reversely rotate. The rotary force in the reverse direction of the joint pinion gear 615 is transmitted to the second rack gear 614, and the second side fence 612 slidably moves from the side of the center line L1 to another end (at which the second side fence 612 has been positioned in the illustrated figure) in the conveyance perpendicular direction.

With such a structure, when the drive motor 617 drives to rotate in the forward direction, the two side fences slidably move to approach to each other toward the center line L1 from lateral end sides in the conveyance perpendicular direction, so that the distance between two side fences is gradually reduced. On the other hand, when the drive motor 617 drives to rotate in the reverse direction, each of the two side fences slidably moves from the side of the center line L1 to the lateral end side so as to retract from each other. According to this, the distance between the two side fences is gradually increased. It is noted that regardless of the moved position of the two side fences, the distance from the center line L1 to the first side fence 611 and that from the center line L1 to the second side fence 612 are the same. It is also noted that regardless of the moved position of two side fences, the center position of the two side fences is the position of the center line L1.

A home position sensor 650 formed of a transmissive photo sensor is disposed at the lateral portion of the drive motor 617. FIG. 9 shows a state in which the first side fence 611 and the second side fence 612 each are positioned at home positions. In this state, as illustrated in FIG. 9, a sensor target portion protrudes downward from the leg portion of the first side fence 611 and the sensor target portion exists between a light emitting element and a light receiving element of the home position sensor 650. With this structure, the home position sensor 650 detects that the first side fence 611 is positioned at its home position. The present home position sensor 650 is a type of optical sensor to optically detect that the first side fence 611 is positioned at a home position. Any other type of detection method such as electromagnetic detection method may be adopted instead.

When a user intends to place a sheet of recording sheet or a bundle of sheets on the manual tray 60 as illustrated in FIG. 7, the user presses an execution button disposed on the panel display of the copier before placement of the sheet. A central processing unit (CPU) mounted in the image forming unit 4 and formed of a random access memory (RAM), a read only memory (ROM), and the like serves as a drive controller and rotates the drive motor 617 in the reverse direction until the home position sensor 650 detects that the first side fence 611 has shifted to the home position. Due to this control, each of the first side fence 611 and the second side fence 612 moves and stops at each home position. The first stacker 61 includes a sheet detector, which will be described later. Upon a recording sheet being placed on the bottom plate 610, this sheet detector detects the recording sheet.

Figure 10:
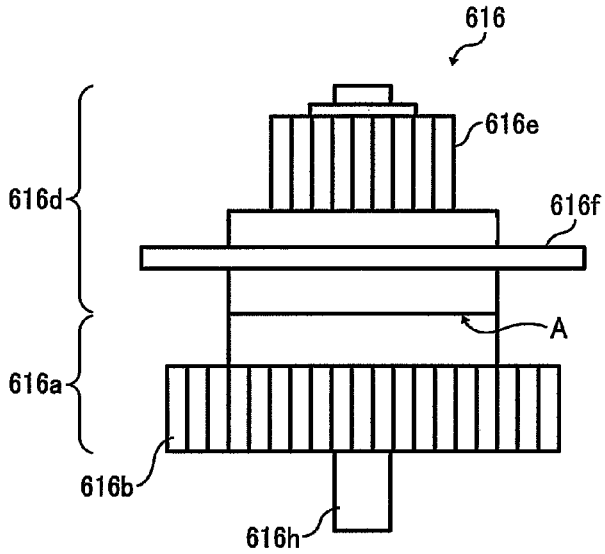
FIG. 10 is an enlarged view of a drive limiter of the first stacker.

FIG. 10 is an enlarged view of the drive limiter 616 of the first stacker 61. The drive limiter 616 includes a drive transmission member 616*a* of the drive source side and a drive transmission member 616*d* of the driven side. The driven side drive transmission member 616*d* is integrally formed of a gear 616*e* and a slit discoid 616*f*. The gear 616*e* engages with the first rack gear 613 (see FIG. 6) being in the driven side. The slit discoid 616*f* includes a plurality of slits arranged with a predetermined pitch in the rotation direction. In addition, the drive source side drive transmission member 616*a* includes a timing pulley 616*b* over which the timing belt 618 (see FIG. 6) is wound. The drive source side drive transmission member 616*a* and the driven side drive transmission member 616*d* each are supported to rotate freely by a support shaft 616*h* which is penetrating the both transmission members. The drive source side drive transmission member 616*a* is biased against the driven side drive transmission member 616*d* by a biasing member, not shown. Then, the drive source side drives transmission member 616*a* contacts with pressure the driven side drive transmission member 616*d* (see A in FIG. 10).

When the drive source side drive transmission member 616*a* rotates by an endless move of the timing belt 618, the driven side drive transmission member 616*d* is driven to rotate accompanied by the drive source side drive transmission member 616*a*. The gear 616*e* of the driven side drive transmission member 616*d* causes the first rack gear 613 to move slidably. However, when a load exceeding a predetermined threshold value is applied to the driven side drive transmission member 616*d*, a force to prevent the driven side drive transmission member 616*d* from rotating exceeds a friction force at a contact portion A between the driven side drive transmission member 616*d* and the drive source side drive transmission member 616*a*. In this case, because at the contact portion, the drive source side drive transmission member 616*a* tends to slip on the surface of the driven side drive transmission member 616*d*, the rotary drive force of the drive source side drive transmission member 616*a* becomes unable to be transmitted to the driven side drive transmission member 616*d*. This causes to stop the slidable movement of the first side fence 611 and the second side fence 612. Thus, the drive limiter 616 stops transmission of the drive force from the drive source side drive transmission member 616*a* to the driven side drive transmission member 616*d* when the load applied to the driven side drive transmission member 616*d* exceeds a predetermined threshold value, to thus stop the first and second side fences on the move.

Figure 1:
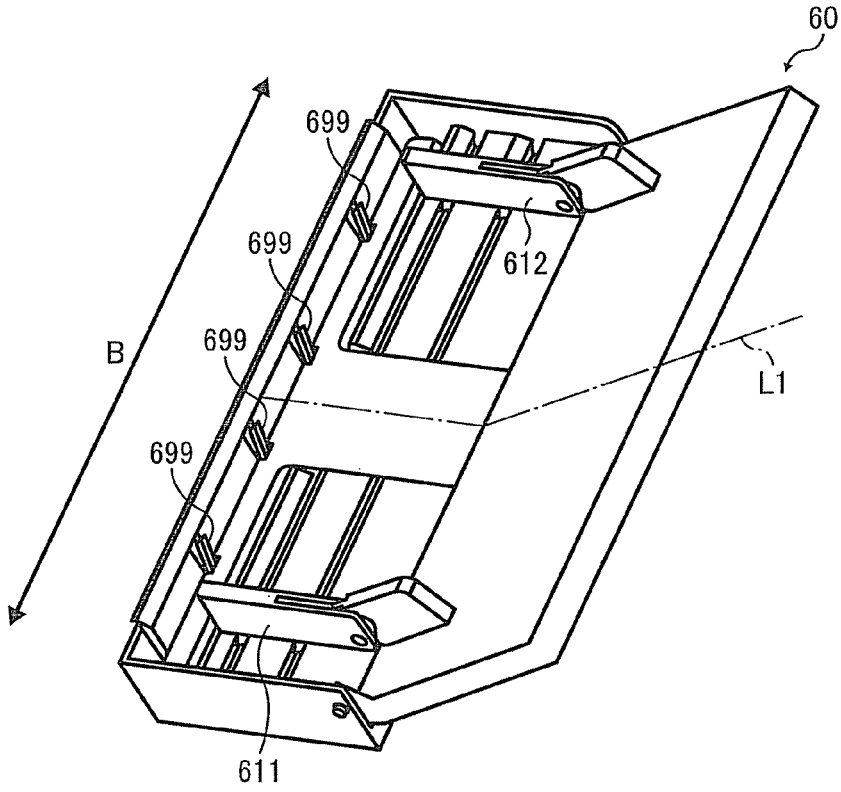
FIG. 1 shows an oblique perspective view of a manual tray under development seen from above.
Figure 2:
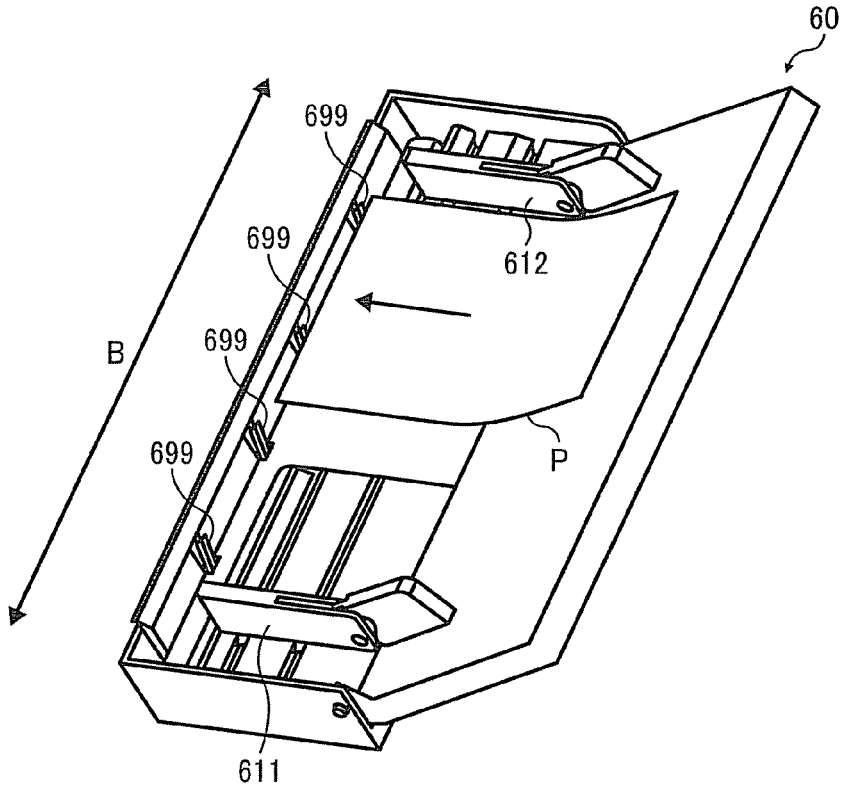
FIG. 2 shows an oblique perspective view of the manual tray in FIG. 1 when a recording sheet is placed thereon.
Figure 3:
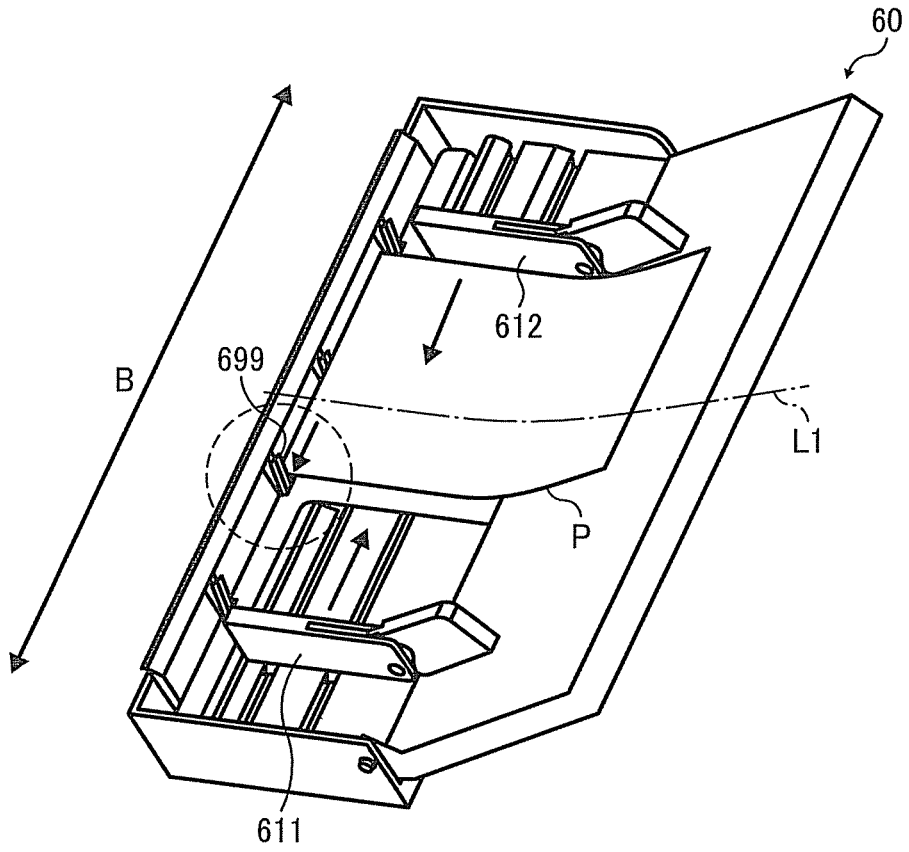
FIG. 3 shows an oblique perspective view of the manual tray in FIGS. 1 and 2 when two side fences are being moved.

As illustrated in FIG. 7, when the user places a recording sheet on the platen formed of such as the bottom plate 610 of the first stacker 61 and the sheet receiving surface 621 of the second stacker 62, he or she presses a positioning button on the control panel 9 (see FIG. 2). Then, the controller causes the drive motor 617 to start to drive in the forward direction. Due to this control, each of the first side fence 611 and the second side fence 612 which have been positioned at each home position starts to slidably move toward the center line L1. In this case, the distance between the second side fence 611 and the second side fence 612 is greater than a size of the recording sheet placed between the fences in the conveyance perpendicular direction (i.e., the arrow B direction). In this state, the recording sheet can be freely moved between two side fences in the conveyance perpendicular direction. Then, each of the first side fence 611 and the second side fence 612 starts to move slidably so that the recording sheet is pushed toward the center line L1 smoothly even though either of the two side fences contacts the recording sheet after starting the slidable movement. Then, each of the first side fence 611 and the second side fence 612 moves to a position in which the recoding sheet is properly sandwiched by the two side fences, that is, the position at which the distance between the two side fences is the same as the size of the recording sheet in the conveyance perpendicular direction. This is when these side fences push against each other via the recording sheet, and therefore, a pressure to be applied to each side fence drastically increases and exceeds a predetermined threshold value. At the same time, because a load exceeding a predetermined threshold value comes to be applied to the driven side drive transmission member 616*d* of the drive limiter 616, the drive source side drive transmission member 616*a* slips on the surface of the driven side drive transmission member 616*d*. With this operation, the controller causes the first side fence 611 and the second side fence 612 to stop slidable movement toward the center line L1. The recording sheet placed freely on the manual tray 60 is properly positioned at the center line L1 and aligned straight along the conveyance direction (the arrow C direction).

In such a construction, a sheet positioning device including the first side fence 611, the second side fence 612, the drive motor 617, the drive transmission unit, and the like is configured to position the recording sheet placed on the sheet platen at the center line L1 being a predetermined proper position in the conveyance perpendicular direction. The sheet positioning device stops slidable movement of the side fences when the size of the recording sheet placed between the fences in the conveyance perpendicular direction substantially equals to the distance between the first side fence 611 and the second side fence 612. According to this, even though a sheet of an indeterminate form is used as the recording sheet, the sheet can be firmly corrected to be a straight posture along the arrow C conveyance direction on the platen.

The threshold value of the load applied to the driven side drive transmission member 616*d* upon the recording sheet is held between the first side fence 611 and the second side fence 612 can be set to the value to cause the drive source side drive transmission member 616*a* to slip on the driven side drive transmission member 616*d* as follows. Specifically, when the load is applied to the driven side drive transmission member 616*d*, a force to prevent driven side drive transmission member 616*d* from rotating is generated. Then, it is recommended that a friction force slightly greater than the above preventive force may be generated at the contact portion A between the drive source side drive transmission member 616*a* and the driven side drive transmission member 616*d*. The friction force can be set at any arbitrary value by properly setting the surface friction resistance of the press-contact area of drive source side drive transmission member 616*a* and the surface friction resistance of the press-contact area of the driven side drive transmission member 616*d*.

In the copier according to the present embodiment, toner images are formed on the photoreceptors of respective colors 21Y, 21M, 21C, and 21K in the method referenced to the center. The referenced-to-the-center method is a method in which images are formed with a center of the photoreceptor in the rotary shaft direction set as a reference, regardless of the size of the recording sheet used. In such a center reference method, the recording sheet needs to be conveyed at the shaft center of the photoreceptor in the image forming unit 4 regardless of the size of the sheet. As illustrated in FIG. 7, the recording sheet can be positioned on the manual tray 60 at the center line L1. The following structure is adopted so that the recording sheet can be positioned at the center line L1 regardless of the size of the recording sheet. Specifically, the drive transmission unit is configured such that not only the first side fence 611 but also the second side fence 612 are slidably movably disposed on the platen and the first side fence 611 and the second side fence 612 receive a force opposite to each other so as to be driven to move along the conveyance perpendicular direction. Further, the drive transmission unit includes the drive limiter 616 serving to stop the first side fence 611 and the second side fence 612 at the same timing.

As a method to determine the reference position of the image, there is a referenced-to-the-side method (or a side reference method) in addition to the referenced-to-the center method (or the center reference method). The side reference method is a method in which images are formed with one side position in the rotary shaft direction of the photoreceptor set as a reference, regardless of the size of the recording sheet used. In such a side reference method, the recording sheet needs to be conveyed at one end position in the shaft center direction of the photoreceptor in the image forming unit 4 regardless of the size of the sheet. Thus, when the side reference method is used, instead of slidably moving the two side fences, a following structure can be preferably used. Specifically, in the conveyance perpendicular direction, the second side fence 612 is fixedly disposed at a position extended from one end in the rotary shaft direction of the photoreceptor. Then, the first side fence 611 only is slidably moved to adjust the position of the recording sheet placed on the platen at a position of the second side fence 612. In the side reference method, only one slidably movable side fence is provided and a function of another side fence can be taken by the tray's side wall.

Figure 11:
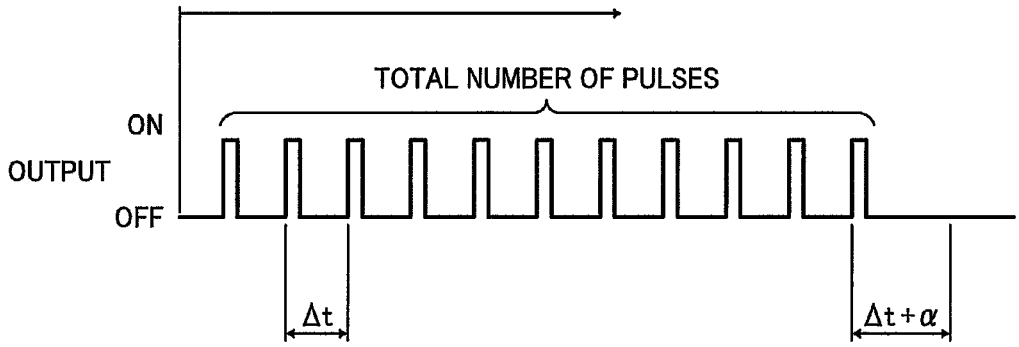
FIG. 11 is a waveform of pulse signals output from a rotary motion sensor of the first stacker.

In the copier according to the present embodiment in which slidable movement of the first side fence 611 and the second side fence 612 is stopped by interrupting the transmission of the drive force from the drive source side to the driven side, the side fences can be stopped while the drive motor 617 continuing to drive. Then, stopping the drive motor 617 when the side fences are stopped is not necessary, but continuing to drive the drive motor 617 indefinitely causes useless energy consumption and shorter life due to the wearing of the apparatus and is not preferable. Accordingly, it is preferred that the drive motor 617 be stopped in a shorter time after the side fences are stopped. Then, the copier according to the present embodiment includes an operation sensor to detect whether the driven side drive transmission member 616*d* is driven or not. The controller serving as a drive controller is configured to perform a procedure to stop driving of the drive motor 617 in the forward rotary direction based on a condition in which the operation sensor no longer detects operation of the driven side drive transmission member 616*d*. As an operation sensor, a rotary motion sensor 619 to detect rotation of the slit discoid 616*f* of the driven side drive transmission member 616*d* is used. As illustrated in FIG. 9, this rotary motion sensor 619 includes a light emitting element so disposed as to face an upper surface of the slit discoid 616*f* and a light receiving element so disposed as to face a lower surface of the slit discoid 616*f*. The light emitting element and the light receiving element sandwich the slit discoid 616*f* in between. A plurality of slits is disposed along the slit discoid 616*f* at a predetermined pitch in the rotation direction. And with the rotation of the slit discoid 616*f*, the light receiving element receives a light from the light emitting element when the slit discoid 616*f* passes through a position opposite the light emitting element. With this structure, when the driven side drive transmission member 616*d* rotates at a constant angular velocity, pulse signals as illustrated in FIG. 11 are output from the rotary motion sensor 619 repeatedly at a constant cycle (Δt). When the rotation of the driven side drive transmission member 616*d* stops, the pulse signals are not output from the rotary motion sensor 619 at a constant cycle (Δt). The output this time is different based on the posture of the slit discoid 616*f* when stopping its rotation. Specifically, when the slit discoid 616*f* stops its rotation with its between-slits portion faces an area opposite the light emitting element of the rotary motion sensor 619, the light from the light emitting element is not incident to the light receiving element of the rotary motion sensor 619. Accordingly, the output from the rotary motion sensor 619 remains turned off. By contrast, when the slit discoid 616*f* stops its rotation with its slit portion faces an area opposite the light emitting element of the rotary motion sensor 619, the light from the light emitting element continues to be incident to the light receiving element of the rotary motion sensor 619. Accordingly, the output from the rotary motion sensor 619 remains turned on. In either case, the state of OFF or ON continues exceeding the generation cycle (Δt) of the pulse signal. Then, when a state in which pulse signals are output from the rotary motion sensor 619 at a constant cycle has changed to a state in which the output OFF state or the output ON state continues exceeding the cycle Δt+constant α, the controller determines that the driven side drive transmission member 616*d* stops its rotation. Upon the determination as above, the controller stops driving the drive motor 617 in the forward rotary direction.

The driving amount of the two side fences from the start of driving to the stop of the driving corresponds to the total of the moving amount from each home position to each stopped position of the side fences. In addition, the above total corresponds to the size of the recording sheet placed between the fences in the conveyance perpendicular direction (i.e., the sheet width size). Accordingly, a function formula or a data table can be structured to obtain a sheet width size based on the driving amount. As illustrated in FIG. 11, the controller of the present copier performs operation to count accumulated value of number of pulses from the driving start to the driving stop as the driving amount. A ROM, a data storage means, stores the function formula or the data table to obtain a sheet width size based on the accumulated value of the number of pulses. Then, the result of counting the pulse-number accumulated values is substituted into the function formula to obtain the sheet width size, or an operation to identify the sheet width size corresponding to the result of counting from the data table is performed. With this operation, the sheet width size of the recording sheet placed on the platen of the manual tray 60 is identified. With this configuration, without inputting the sheet width size of the recording sheet placed on the platen of the manual tray 60, the sheet width size can be automatically identified by the controller.

When regardless of the position of the two side fences, the drive motor 617 is driven at a constant driving speed to move the fence slidably, the driving time being a time period taken from the driving start to the driving stop can be adapted as a driving amount from the driving start to the driving stop instead of the pulse-number accumulated value. In this case, the sheet width size $L_x$ can be obtained by a following formula: $L_x=L_0-t_f x2V_f$. In this function formula, $L_0$ represents an initial distance [in cm] between fences when two side fences reside at their own home positions. $t_f$ represents a moving time period [in second] of the fence. $V_f$ represents a moving speed [in cm/sec.] of each side fence and has no plus or minus sign to show the moving direction of the fence whether it is directed to one end side or the other end side.

As already described along with FIG. 10, the drive limiter 616 as a stopper stops transmission of the drive force from the drive source side drive transmission member 616*a* to the driven side drive transmission member 616*d* when the load applied to the driven side drive transmission member 616*d* exceeds a predetermined threshold value, to thus stop the first side fence on the move. In the copier according to the present embodiment, as a method to stop the drive force transmission from the drive source side drive transmission member 616*a* to the driven side drive transmission member 616*d* when the load exceeds a predetermined threshold value, a method to rotate the driven side drive transmission member 616*d* by the pressure contact with the rotating drive source side drive transmission member 616*a* is adapted. Instead, a method to linearly move the driven side drive transmission member 616*d* in the same direction by the contact with pressure to the linearly moving drive source side drive transmission member 616*a* may be adapted.

It is preferred that the threshold value of the load applied to the driven side drive transmission member 616*d* be a load that occurs when a sheet of thin paper is sandwiched between two slidably moving side fences, or less (that is, the thin paper load). With this configuration, even when a sheet of thin paper is placed, upon the sheet is sandwiched by two side fences, the drive force to the two side fences can be turned off. By contrast, when a bundle of recording sheets with a stackable maximum load capacity is placed on the manual tray 60, the preferable threshold value should be greater than the load that occurs when the bundle of recording sheets slidably moves (that is, the maximum load capacity load). Without this capability, the bundle of recording sheets with a maximum load capacity cannot be slidably moved and positioning cannot be performed. Accordingly, it is preferred that a relation maximum load capacity load<threshold value<thin paper load be satisfied. From the above relation, the thin paper load should be larger than the maximum load capacity load. But it is common that the relation is reversed.

Figure 12:
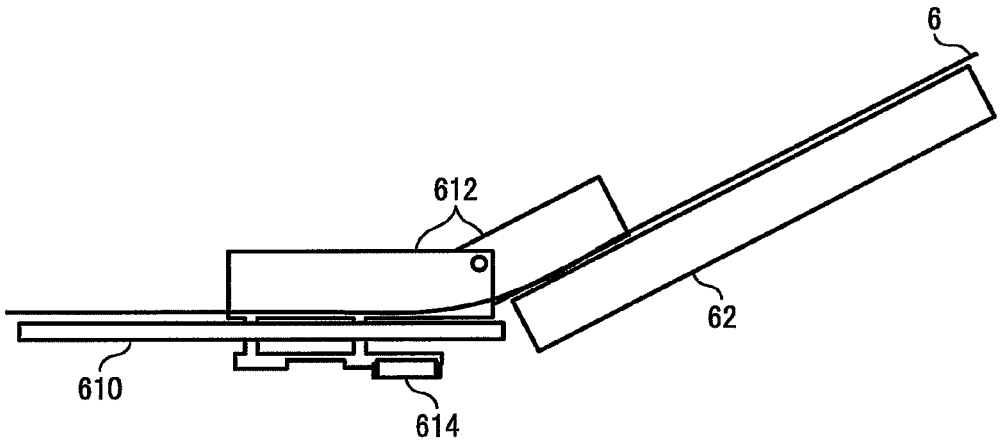
FIG. 12 is a side view illustrating the manual tray seen from a lateral side.

Then, the copier according to the present embodiment adopts a following structure. Specifically, as illustrated in FIG. 7, the sheet receiving surface 621 serving as a rear end placement surface has a slanted posture with an inclined angle θ relative to the bottom plate 610 serving as a front end placement surface. The inclined angle θ is an angle formed by an extended line of the sheet conveyance direction (i.e. the arrow C direction) of the front end placement surface and an extended line of the sheet conveyance direction of the rear end placement surface and has an inclined angle of less than 180 degrees in the illustrated example. When the front end placement surface (bottom plate 610) and the rear end placement surface (sheet receiving surface 621) form an inclined angle, the recording sheet placed thereon also has a bending posture along the inclined surface. As illustrated in FIG. 12, the second side fence 612 is configured to slidably move at a position contacting the inclined portion of the recording sheet 6. The first side fence 611 is similarly configured to slidably move at a position contacting the inclined portion of the recording sheet 6. This inclined portion gives, when the sheet is sandwiched between two side fences, a load greater than the load, if compared to the non-inclined sheet portion, to the driven side drive transmission member 616*d*. With this structure, because the thin paper load is greater than the maximum load capacity load, it is enabled to set the threshold to satisfy the relation, maximum load capacity load<threshold value<thin paper load. As to the adjustment of the threshold value, a surface friction resistance of the pressure contact portion A of the driven side drive transmission member 616*d* and a surface friction resistance of the drive source side drive transmission member 616*a* is adjusted so that the above relation can be satisfied. Thus, even when only one sheet of thin paper is placed on the sheet placement surface of the manual tray 60, the normal sheet can be properly adjusted at the position of the center line L1 without causing the slidably moving side fence to stop on the way. Further, upon one normal sheet is sandwiched between fences, a load exceeding the threshold value is applied to the driven side drive transmission member 616*d* firmly. With this operation, the slidable movement of the side fences can be stopped at a proper timing not to cause the distance between fences to be smaller than the sheet width size.

In the copier according to the present embodiment, as illustrated in FIG. 4, a press roller 605 is disposed to firmly incline the recording sheet placed on the manual tray 60 along the inclined angle θ. This press roller 605 is rotatably disposed at a tip end of a swing arm 604 which is swingably supported to the side face of the image forming unit 4. Then, the press roller 605 softly touches the area of the recording sheet 6 between the bottom plate 610 and the sheet receiving surface 621 on the manual tray 60 and the recording sheet 6 can be inclined firmly along the inclined angle θ.

Figure 13:
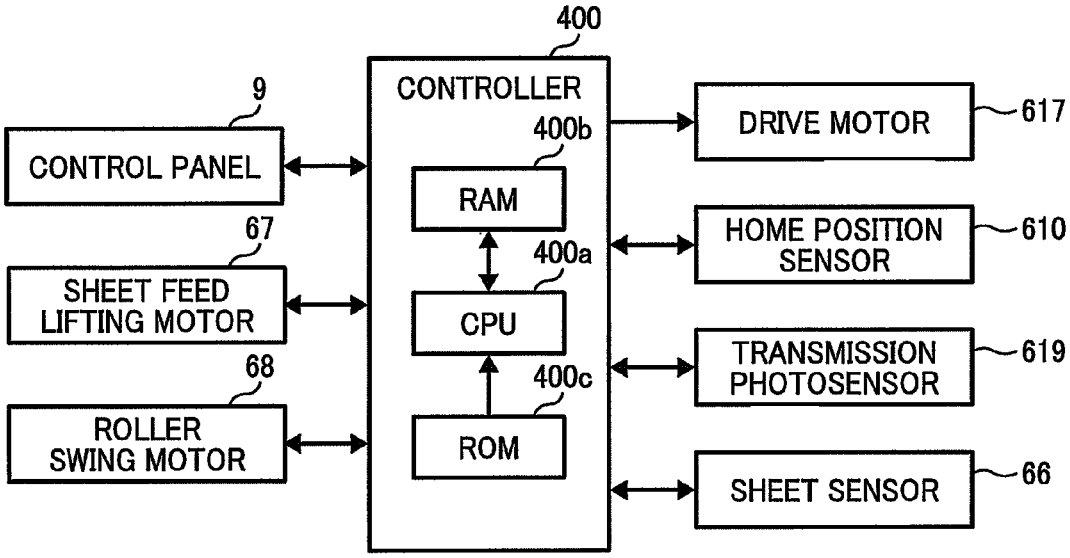
FIG. 13 is a block diagram illustrating a part of electric circuit of the copier.

FIG. 13 is a block diagram illustrating a part of electric circuit of the copier according to one embodiment of the present invention. In the same figure, the controller 400 serving as a drive controller controls driving of various devices and components incorporated in the copier. This controller 400 is connected with various devices and components, but only the devices related to the positioning of the recording sheet on the manual tray 60 are particularly shown. The controller 400 is connected to the drive motor 617, the home position sensor 650, the rotary motion sensor 619, the sheet sensor unit 66, and the control panel 9. In addition, a sheet lifting motor 67 and a roller swing motor 68 are connected to the controller 400. The sheet sensor unit 66 detects a recording sheet placed on the bottom plate 610 as illustrated in FIG. 7. In addition, the sheet lifting motor 67 serves to move up and down the sheet feed roller 601 (see FIG. 4) with respect to the manual tray 60. Further, the roller swing motor 68 serves to swing the press roller 605 together with the swing arm 604.

Figure 14:
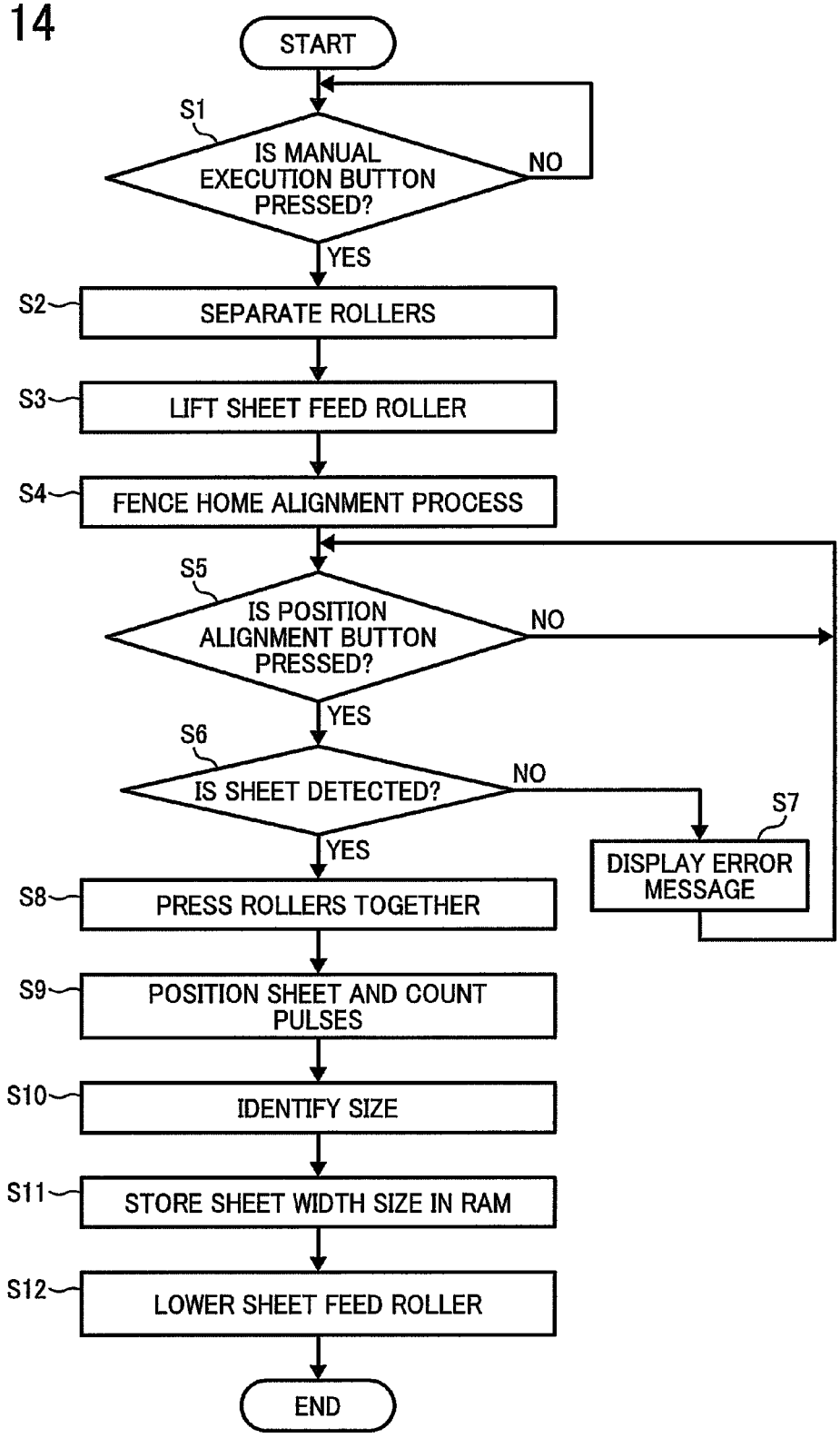
FIG. 14 shows a flowchart illustrating a series of process of sheet positioning performed by a controller of the copier.

FIG. 14 shows a flowchart illustrating a series of process of sheet positioning performed by the controller 400. Upon the user presses a manual operation execution button (Yes in step S1 and S means Step), the controller 400 sequentially performs a roller separation process (S2), a sheet feed roller lifting process (S3), and fence home position alignment process (S4). The roller separation process (S2) is a process to largely retract the press roller 605 from the sheet placement surface of the manual tray 60 by driving the roller swing motor 68 reversely until a predetermined timing comes. The sheet feed roller lifting process (S3) is a process to lift the sheet feed roller 601 up to a position not contacting the sheet bundle on the placement surface by reversely driving the sheet lifting motor 67 until a predetermined timing comes. The fence home alignment process (S4) is a process in which the drive motor 617 is reversely driven until the home position sensor 610 detects the first side fence 611. With this operation, each of the first side fence 611 and the second side fence 612 slidably moves and stops at each home position.

Upon the completion of fence home alignment process (S4), the controller 400 waits until the user pushes a positioning button of the control panel 9. When the positioning button is pressed down (Yes in S5), the sheet sensor unit 66 detects whether or not the recording sheet is placed on the platen (S6). If the recording sheet is not detected (No in S6), after an error message to show that the recording sheet is not placed is displayed on the LED window of the control panel 9 (S'), the process flow is looped to S5. Due to this, the controller again waits until the positioning button is pressed down. By contrast, when the recording sheet on the platen is detected by the sheet sensor (Yes in S6), a roller pressing process (S8), a positioning and pulse count process (S9), and a size identification process (S10) are sequentially performed. The roller pressing process (S8) is a process to foster the recording sheet to incline further by driving the roller swing motor 68 to forwardly rotate to get to be a predetermined timing so that the press roller 605 contacts the recording sheet on the manual tray 60 with a very slight contact force. The position alignment and pulse count process (S9) is a process to position the recording sheet at the position of the center line L1 by slidably moving two side fences, and a process to count the number of pulse signals output from the rotary motion sensor 619. The size identification process (S10) is a process to identify a sheet width size of the recording sheet placed on the manual tray 60 based on the accumulated value of the number of pulses obtained by counting. The detail thereof has been already described.

The controller 400 that has identified the sheet width size of the recording sheet by the size identification process (S10), stores the value in the RAM 400*b* (S11), performs the sheet feed roller lowering process (S12), and terminates the series of process flow. The sheet feed roller lowering process (S12) is a process, by causing the sheet feed lifting motor 68 to forwardly rotate until a predetermined timing comes, to lower the sheet feed roller 601 up to a position to contact the topmost recording sheet among the sheet bundle on the placement surface.

Figure 15:
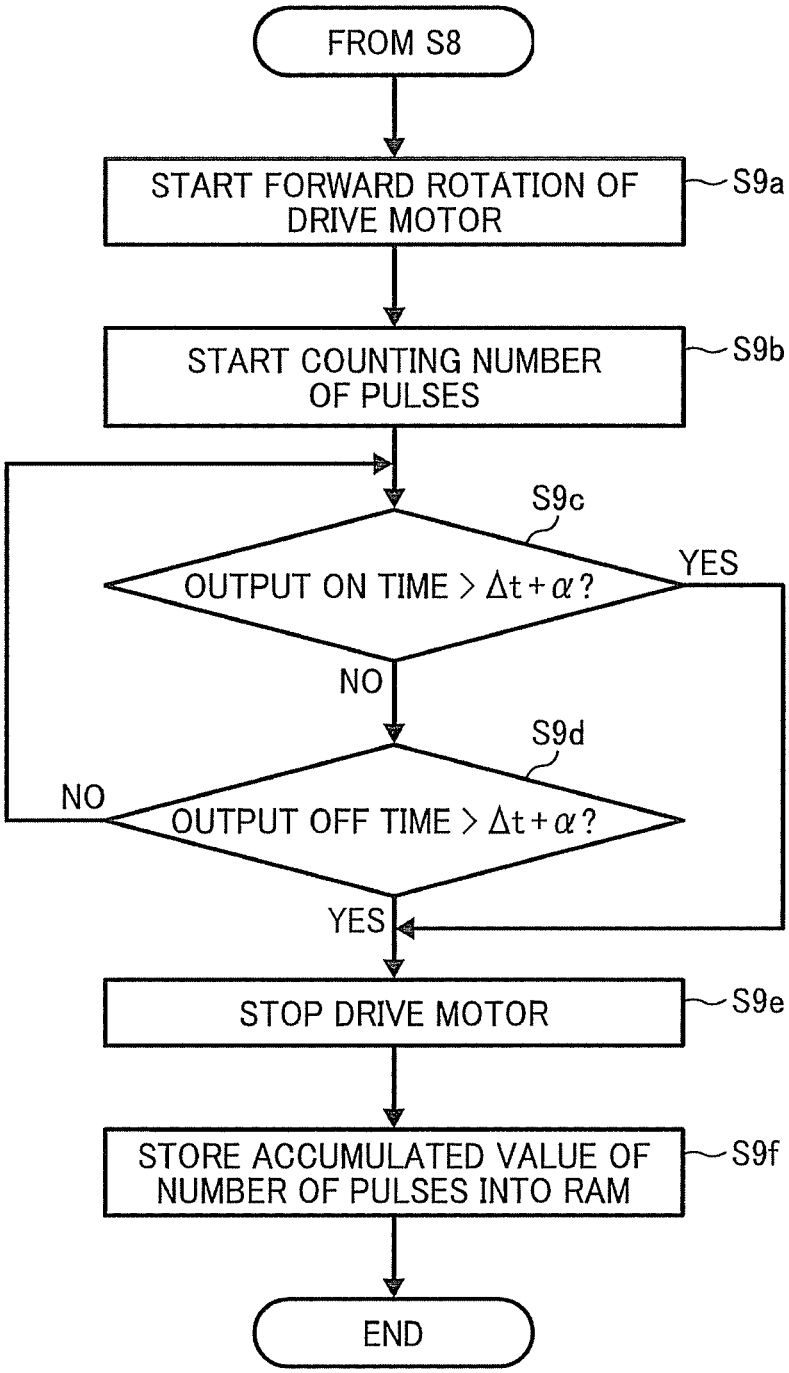
FIG. 15 is a flowchart illustrating a series of process in the position alignment and pulse count process.

FIG. 15 shows a flowchart illustrating a series of process in the position alignment and pulse count process (S9). When the position alignment and pulse count process (S9) starts, the controller 400 first starts a forward rotation of the drive motor 617 (S9*a*), and starts to slidably move the two side fences from their home positions toward the center line L1. Substantially at the same time, the controller starts counting pulse signals output from the rotary motion sensor 619. Then, as to output from the rotary motion sensor 619, it is determined whether the duration of the output ON exceeds the value "pulse cycle Δt+constant α" or not (S9*c*) and it is determined whether the duration of the output OFF exceeds the value "pulse cycle Δt+constant α" or not (S9*d*). Then, either one of the durations exceeds the value "pulse cycle Δt+constant α" (Yes in S9*c* or Yes in S9*d*), the controller stops driving of the drive motor 617. With this operation, the two side fences each are stopped at positions in which the distance between fences becomes substantially the same as the sheet width size. Thereafter, the accumulated value of the number of pulses is stored in the RAM 400*b* and the position alignment and pulse count process terminates.

Figure 16:
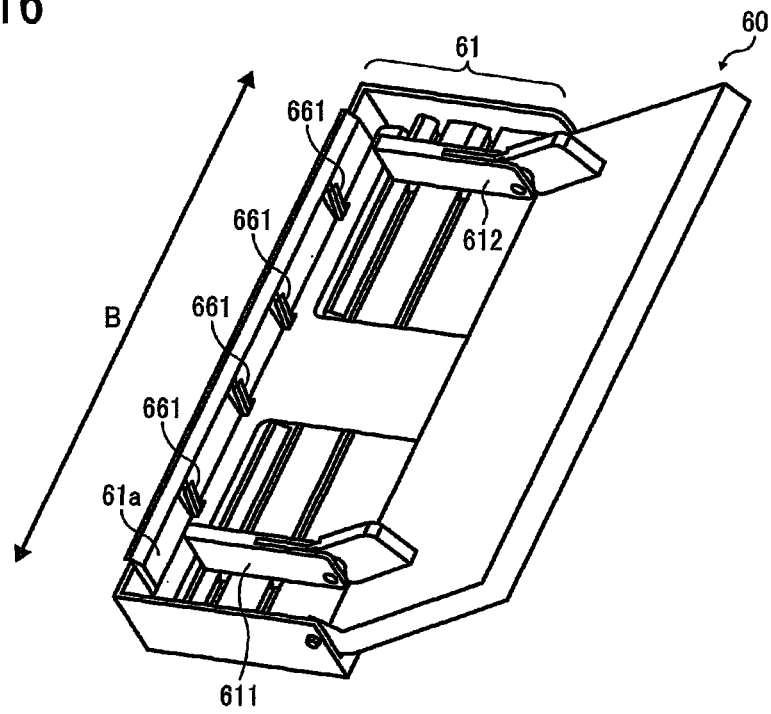
FIG. 16 is an oblique perspective view of the manual tray seen from above.

FIG. 16 is an oblique perspective view of the manual tray 60 seen from above. A contact case 61*a* is disposed at a front end of the interior of the tray of the first stacker 61 of the manual tray 60. This contact case 61*a* contacts a front end of the recording sheet to be placed on the placement surface of the first stacker 61. A slanted surface descending toward the front end from the rear along the sheet conveyance direction is provided on the placement surface of the first stacker 61. The recording sheet placed on the placement surface is press-contacted with the contact case 61*a* by its own weight along the slanted surface.

Four sheet detection levers 661 of the sheet sensor unit 66 (see FIG. 13) are disposed at a front end of the first stacker 61. Each sheet detection lever 661 is disposed positioned at predetermined intervals in the conveyance perpendicular direction (i.e., arrow B direction) and a lever end which contacts the recording sheet is configured to protrude from a case of the tray directly upward via each opening provided in the contact case 61*a*.

Figure 17:
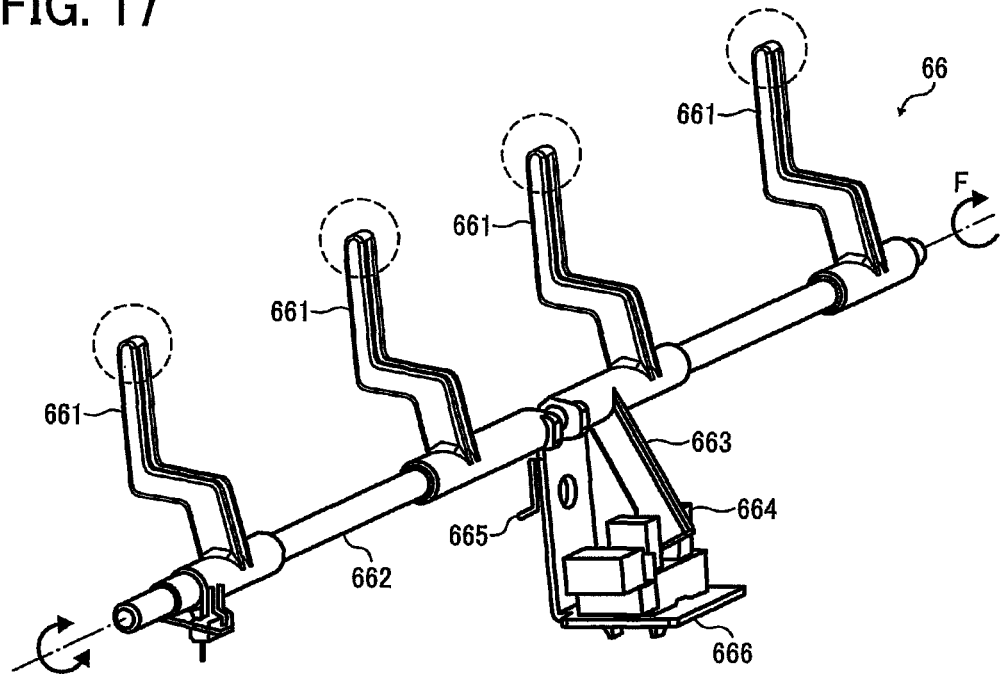
FIG. 17 is an oblique perspective view illustrating a sheet sensor unit of the manual tray.

FIG. 17 is an oblique perspective view illustrating a sheet sensor unit 66. This sheet sensor unit 66 includes four detection levers 661, a swing shaft 662 as a connecting member, a detection-target lever 663, a transmissive photosensor 664, a coil spring 665, and a bracket 666. The swing shaft 662 is so supported by the bracket 666 as to swing about a swing shaft as illustrated by a broken line in FIG. 17. The four detection levers 661 and the detection-target lever 663 are fixed to the swing shaft 662 so as to integrally swing with the swing shaft 662. In addition, a ring of the coil spring 665 is inserted into the swing shaft 662. The coil spring 665 is fixed to the swing shaft 662 and the bracket 666 so as to give a rotary force to the swing shaft 662 in the direction indicated by an arrow F about the swing shaft. Due to this force of the coil spring 665, the swing shaft 662 is latched at a position such that each front end of the four detection levers 661 contacts the bottom plate of the first stacker 61 as illustrated in FIG. 16. The four detection levers 661 swing between a first position being a position as illustrated in FIG. 16 and a second position pivotally about the swing shaft. In a state in which the recording sheet is not placed on the placement surface of the first stacker 61, the four detection levers 661 fixed to the swing shaft 662 to be biased in the arrow F direction by the coil spring 665 each are halted at the first position contacting the bottom plate of the first stacker 61.

In the state in which the four detection levers 661 are halted at the first position, as illustrated in FIG. 17, the detection-target lever 663 fixed to the swing shaft 662 is evacuated from a position detected by the transmissive photosensor 664. Specifically, in the state in which the four detection levers 661 are halted at the first position, the detection-target 663 is not detected by the transmissive photosensor 664.

Figure 18:
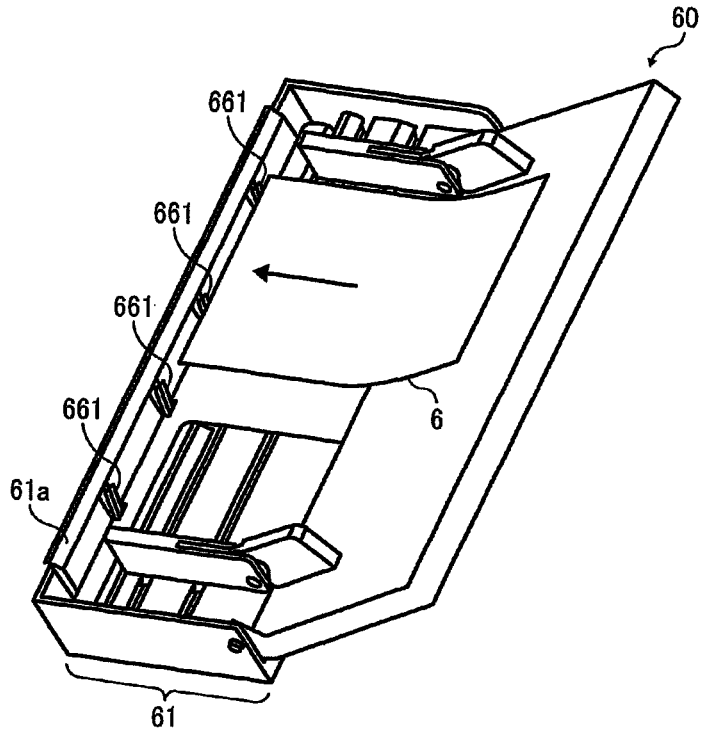
FIG. 18 is an oblique view illustrating the manual tray and a recording sheet placed on the placement surface.

When the user places a recording sheet on the placement surface of the manual tray 60 as illustrated in FIG. 16, the leading end of the recording sheet contacts at least one of the four detection levers 661. For example, FIG. 18 shows a state in which the leading end of the recording sheet 6 contacts two of the four detection levers 661. The detection lever 661 contacting the leading end of the recording sheet 6 rotates by a predetermined angle in a direction reverse to the biased direction pivotally about the swing shaft, i.e., the broken line in FIG. 17, against the biasing force of the coil spring 665 in FIG. 17. Due to this, the detection lever 661 moves from the first position in which the detection lever 661 protrudes from the opening of the contact case 61*a* to the second position in which the detection lever 661 does not protrude therefrom. In this case, even the detection lever 661 not contacting the leading end of the recording sheet 6 moves integrally with the detection lever 661 contacting the recording sheet 6 from the first position to the second position. Thus, if either one of the four detection levers 661 contacts the leading end of the recording sheet 6, all detection levers 661 evacuate from the first position to the second position.

In the state in which the four detection levers 661 are halted at the second position, the detection-target lever 663 in FIG. 17 moves from a position not detected by the transmissive photosensor 664 to a detectable position. With this operation, the transmissive photosensor 664 outputs a detection signal to the controller 400.

Figure 19:
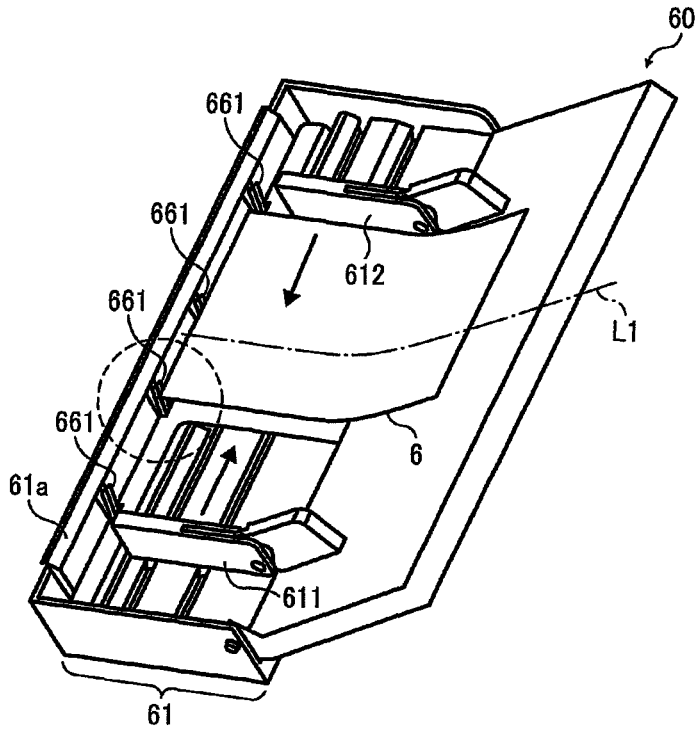
FIG. 19 is an oblique view illustrating the manual tray when the recording sheet is being positioned.
Figure 20:
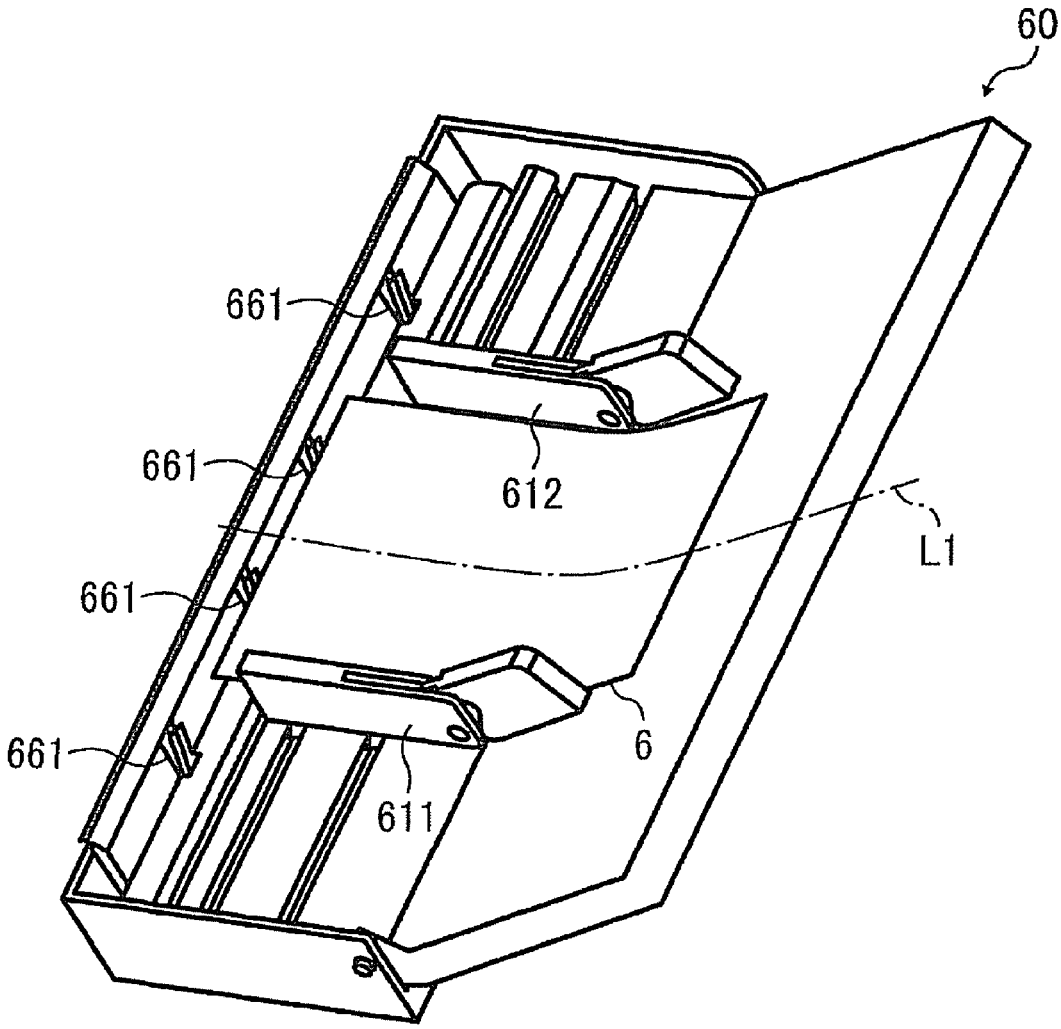
FIG. 20 is an oblique view illustrating the manual tray after the positioning of the recording sheet is completed.

With this configuration, not only the detection levers 661 contacting the recording sheet 6 but the detection levers 661 not contacting it evacuate to the second receded position as illustrated in FIG. 19 and causes the recording sheet 6 under positional adjustment to move in the conveyance perpendicular direction. With this structure, the recording sheet 6 does not get stuck with the detection lever 661 not contacting the recording sheet 6, and can be moved to the position of the center line L1 as illustrated in FIG. 20.

The manual tray 60 can stack the maximum A-3 sized recording sheet 6 in the longitudinal posture. The longitudinal posture means that the sheet is stacked with its longer side of the sheet along the conveyance direction. The shorter side of the A-3 sized recording sheet measures 297 mm. The length in the conveyance perpendicular direction on the placement surface of the manual tray 60 is substantially 330 mm so that the recording sheet 6 can be stacked on the manual tray 60.

Home positions of the two side fences 611 and 612 are greatly spaced away from each other. In such a state in which the two side fences are positioned at respective home positions, the distance between those side fences is 320 mm. Specifically, in the manual tray 60, a maximum distance between two side fences is set to be 320 mm. An A3-sized sheet can be placed in the space of 320 mm. A printable minimum-sized sheet determined as a design standard is an E-sized photo sheet in the present copier. The printable minimum-sized sheet determined as a design standard is specified in a handling manual of the copier for example "please use a XX-sized or greater sheet for this copier."

Figure 21:
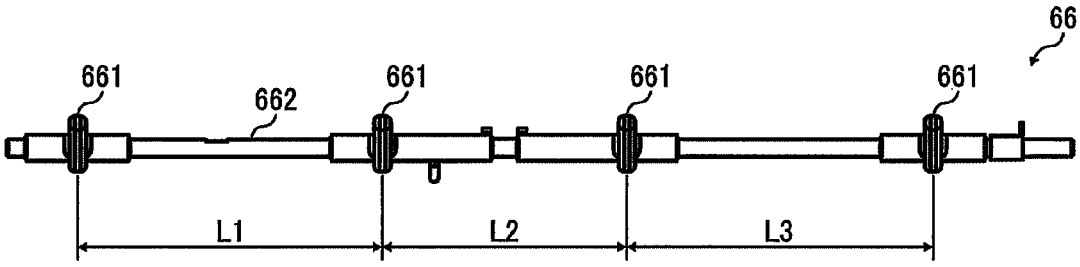
FIG. 21 is a plan view illustrating part of the sheet sensor unit.

FIG. 21 is an oblique perspective view illustrating the sheet sensor unit 66. As illustrated in FIG. 21, among four detection lever 661 fixed to the swing shaft 662, a distance L1 between a first detection lever 661 at the leftmost in the figure to a second detection lever 661, a distance L2 between the second detection lever 661 and a third detection lever 661, and a distance L3 between the third detection lever 661 and a fourth detection lever 661 are all shorter than the shorter side length (83 mm) of the E-sized photo sheet. When two side fences 611, 612 are positioned at respective home positions, the distance between the first side fence 611 and the nearest detection lever 661 (which is the leftmost detection lever 661) is also shorter than the shorter side length of the E-sized photo sheet. Further, the distance between the second side fence 612 at its home position and the nearest detection lever 661 (which is the rightmost detection lever 661) is also shorter than the shorter side length of the E-sized photo sheet. With this structure, the recording sheet having a width equal to or larger than the minimum-sized sheet is placed at any place on the sheet placement surface of the manual tray 60, the leading end of the sheet contacts any of the detection levers 661 and the contact can be detected by the sheet sensor unit 66.

Figure 22:
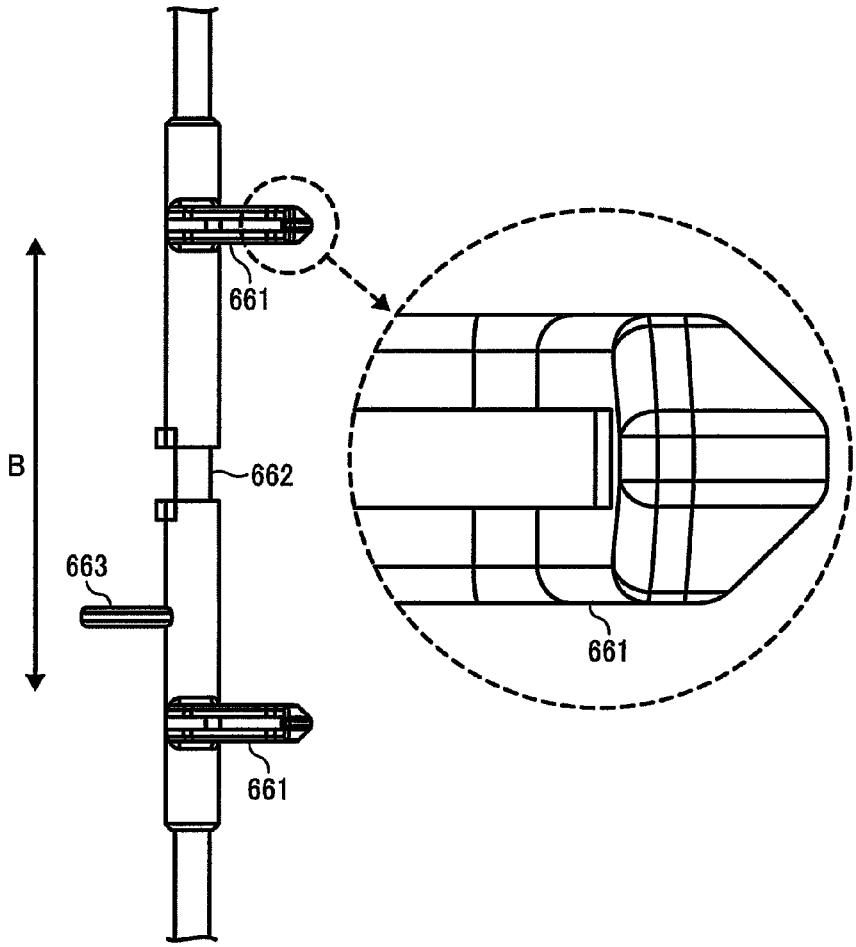
FIG. 22 is a partial enlarged view illustrating the sheet sensor unit.
Figure 23:
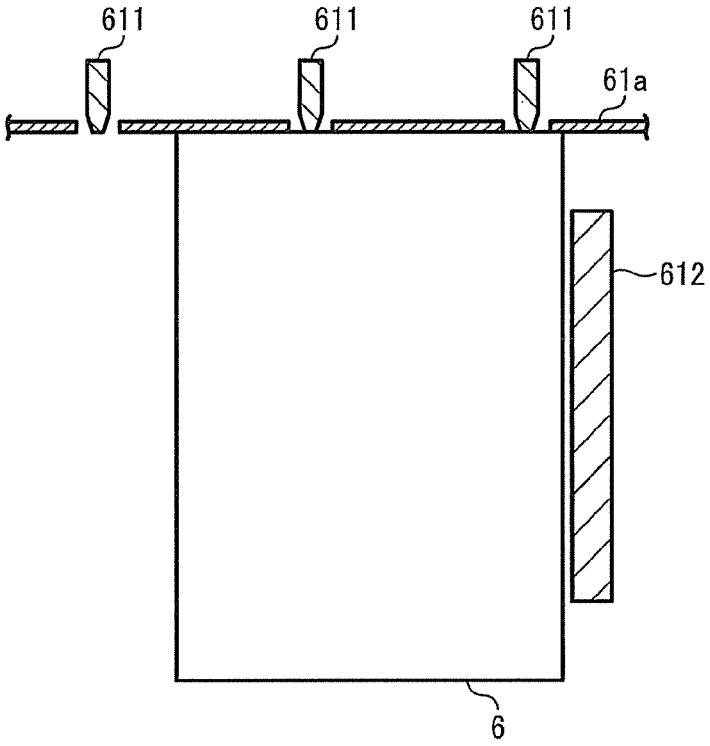
FIG. 23 is a plan view illustrating a contact case, detection levers, and the second side fence of the manual tray along with the recording sheet placed in the normal posture.
Figure 24:
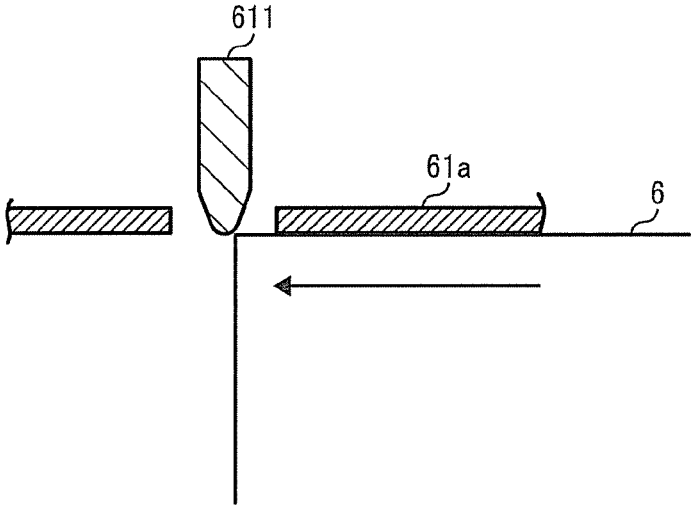
FIG. 24 is an enlarged cross-sectional view illustrating the contact case, the detection lever, together with the recording sheet being positioned in the normal posture.
Figure 25:
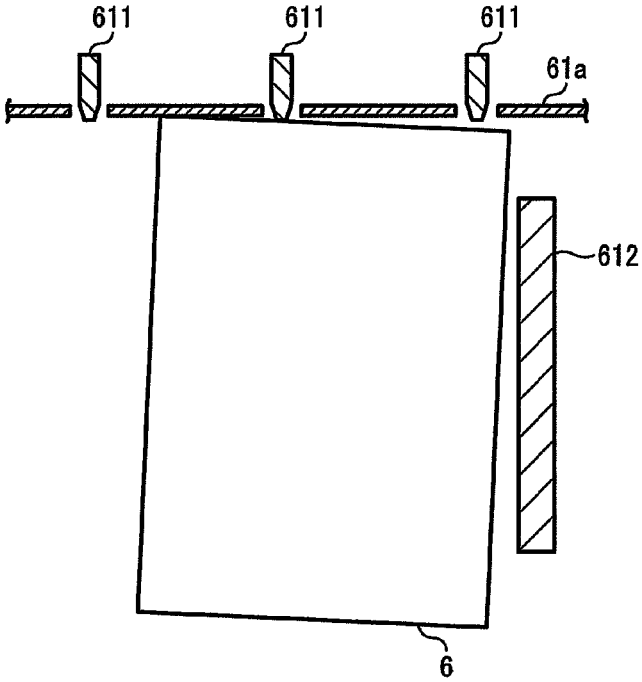
FIG. 25 is a plan view illustrating the contact case, the detection levers, and the second side fence of the manual tray along with the recording sheet placed in the slanted posture.
Figure 26:
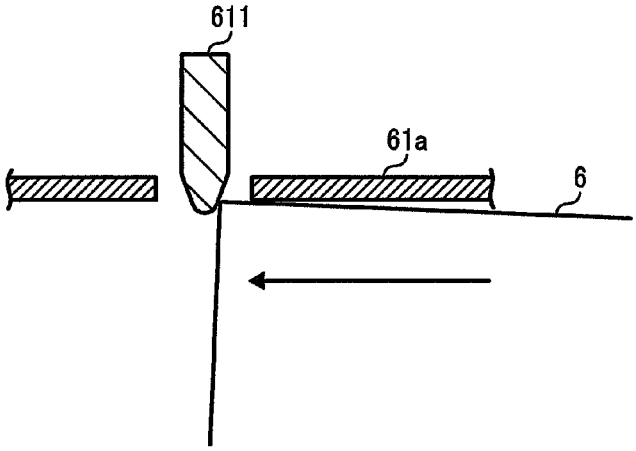
FIG. 26 is an enlarged cross-sectional view illustrating the contact case, the detection lever, along with the recording sheet being positioned in the slanted posture.

FIG. 22 is a partial enlarged view illustrating the sheet sensor unit 66. As illustrated in FIG. 22, a part of the detection lever 661 to contact the recording sheet is formed to have a taper end. The taper is formed to be gradually reduced in size toward its tip end (from downstream to upstream in the conveyance direction). With this taper, even when the recording sheet 6 is placed in an uncompleted status in which the leading edge of the sheet does not contact the contact case 61*a*, the recording sheet 6 is prevented from getting stuck with the detection lever 661. Specifically, when the recording sheet 6 is placed so as to be straightly conveyed along the conveyance direction as illustrated in FIG. 23, substantially all area of the leading end of the recording sheet 6 strikes the contact case 61*a*. In this state, all leading edges of the detection levers 661 recede to a position at the same level of the contact surface of the contact case 61*a*. Accordingly, even though the recording sheet 6 to be moved in the conveyance perpendicular direction by positioning actually moves to the position of the third detection lever 661 which the recording sheet 6 did not contact previously as illustrated in FIG. 24, the third detection lever 661 does not contact the recording sheet 6 sideways. With this structure, the recording sheet 6 does not get stuck with the detection lever 661 which is to be moved in the conveyance perpendicular direction for positioning. However, it is assumed that the recording sheet 6 is placed in a state somewhat slanted from the conveyance direction as illustrated in FIG. 25. In this state, a tip of the entire leading end of the recording sheet 6 contacts the contact case 61*a*, and the area contacting the detection lever 661 is slightly away from the contact surface of the contact case 61*a*. Accordingly, each of the four detection levers 661 (three of four detection levers are illustrated in FIG. 25) slightly protrudes from the contact surface. In this state, when the recording sheet 6 is caused to move in the conveyance perpendicular direction for positioning, the leading end of the recording sheet 6 contacts the tip end of the detection lever 661 sideways which the recording sheet 6 did not contact previously. Even though the recording sheet 6 contacts the detection lever 661, because the tip end of the detection lever 661 is formed to have a taper, the detection lever 661 is pushed toward inside the contact case 61*a* along with the move of the recording sheet 6 in the conveyance perpendicular direction while the recording sheet 6 slidably moving along the taper. As aforementioned, even though the recording sheet 6 is placed in an incomplete status in which the leading end of the sheet does not contact the contact case 61*a*, the recording sheet 6 is prevented from getting stuck with the detection lever 661.

Figure 27:
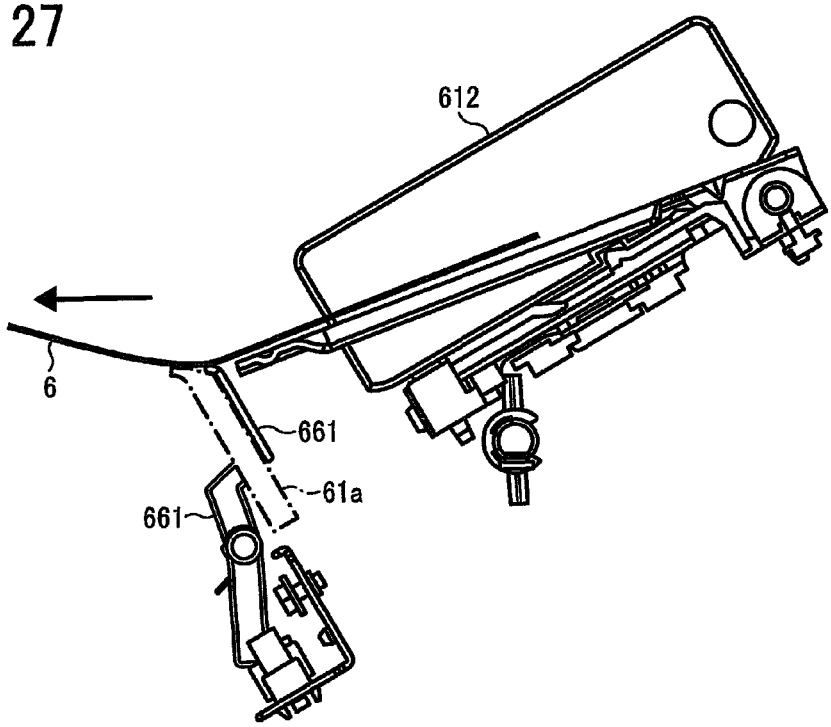
FIG. 27 is a partial cross-sectional view of the manual tray along with the recording sheet immediately before completely discharged from the manual tray.
Figure 28:
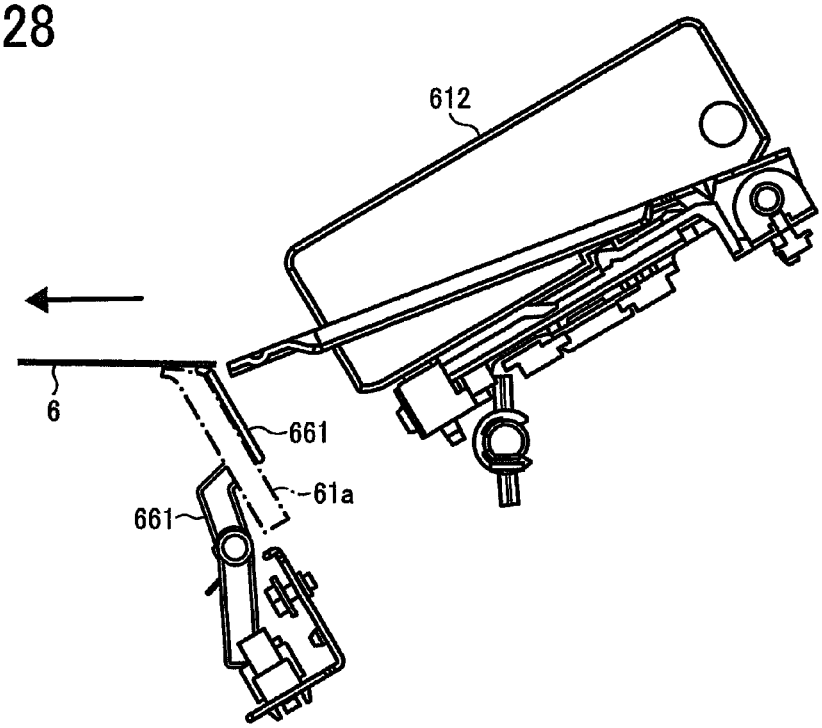
FIG. 28 is a partial cross-sectional view of the manual tray along with the recording sheet being conveyed via the manual tray.

The manual tray 60 includes the first stacker 61 (see FIG. 16) which includes a placement surface formed to have a slanted surface descending from upstream to downstream of the sheet conveyance direction. Then, the leading end of the recording sheet placed on the placement surface is press-contacted to the contact case 61*a* by its own weight along the slanted surface. Further, in the copier according to the present embodiment, the detection lever 661 is restricted to the second position against a biasing force from the coil spring 665 (see FIG. 17) by a friction force with the recording sheet 6 being conveyed from the placement surface as illustrated in FIGS. 27 and 28. In such a structure, until all the recording sheets 6 stacked on the placement surface in overlaid manner are completely conveyed from the placement surface, the recording sheet 6 can be detected by the sheet sensor unit 66.

As illustrated in FIG. 4, the copier according to the present embodiment includes a sheet positioning device according to the embodiment of the present invention for not only the manual tray 60 but for the sheet feed trays 41 of the image forming unit 4, the sheet discharge tray 80 of the image forming unit 4, the original tray 200 of the scanner 3, and the relay tray 209*b* of the scanner 3. The structure of those sheet positioning devices is identical to that of the sheet positioning device incorporated in the manual tray 60.

Figure 29:
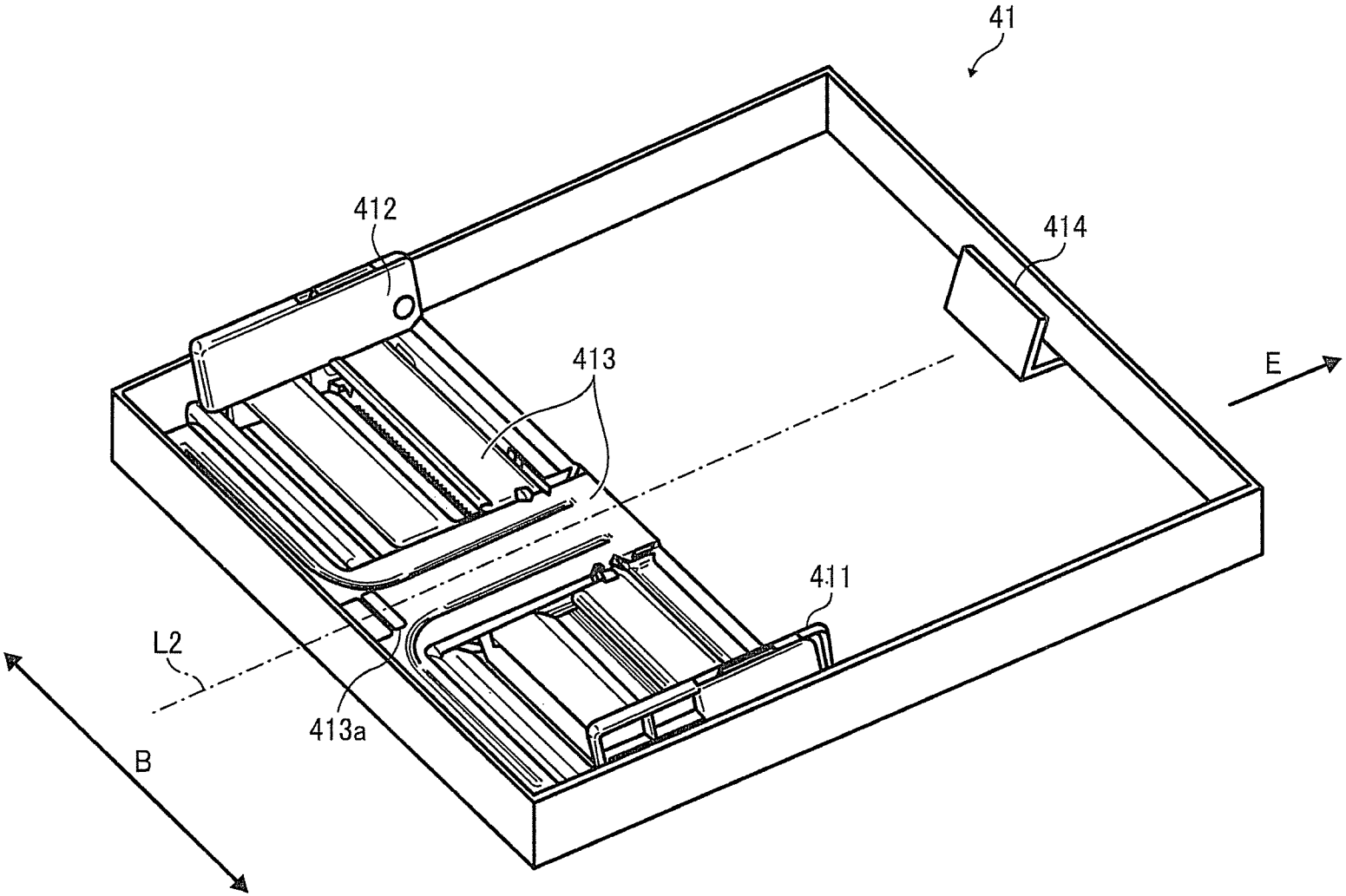
FIG. 29 is an enlarged oblique view illustrating a sheet feed cassette to be detachably attached to the image forming unit of the copier.

FIG. 29 is an enlarged oblique perspective view illustrating the sheet feed cassette 41. The sheet feed cassette 41 as a sheet stacker includes bottom plates 413 to serve as a front end placement surface among all areas of the placement surface to place the recording sheet thereon. The sheet feed cassette 41 further includes a first side fence 411 and a second side fence 412 both so disposed as to slidably move in the conveyance perpendicular direction (i.e., arrow B direction in the figure) on the surface of the bottom plate 413, and an end fence 414 to regulate a front end position of the recording sheet in the sheet feed cassette 41. A broken line L2 shows a center line in the conveyance perpendicular direction of the sheet feed cassette 41, and extends in the conveyance perpendicular direction along the same position as the center line L1 of the manual tray and the center line of the rotation shaft of the photoreceptor.

Although not illustrated in the same figure, below the bottom plate 413, similar members as in the sheet positioning device of the manual tray 60 including a drive limiter, a first rack gear, a second rack gear, a joint pinion gear, a drive motor, a timing belt, a home position sensor, a rotary motion sensor, and a sheet sensor unit are disposed. Then, the first side fence 411 and the second side fence 412 slidably moves based on the same principle as described in the sheet positioning device for the manual tray 60 so that the position of the recording sheet placed between fences is adjusted at the center line L2. In addition, the drive motor and various sensors incorporated in the sheet feed cassette 41 are electrically connected to the controller inside the body of the image forming unit upon the sheet feed cassette 41 is mounted at a predetermined position inside the image forming unit.

As previously shown in FIG. 4, the sheet feed roller 42 contacts the bundle of the recording sheets contained in the sheet feed cassette 41. This sheet feed roller 42 is supported by an interior wall of the image forming unit 4 not by the sheet feed cassette 41. With the sheet feed cassette 41 mounted inside the image forming unit 4, when a user presses down a paper supply button on the control panel, the controller 400 reversely drives the sheet feed roller lifting motor inside the apparatus up to a predetermined timing. Accordingly, the sheet feed roller 42 is largely moved away from each of the two sheet feed cassette 41. In addition, the controller reversely drives the drive motor individually disposed at each of the two sheet feed cassettes 41 and moves the side fences of each sheet feed cassette 41 to respective home positions. When the user pulls the sheet feed cassette 41 from the image forming unit 4 in this state, the user places a sheet bundle on the bottom plate 413 of the sheet feed cassette 41, and thereafter, returns the sheet feed cassette 41 into the apparatus body. Then, the user presses down a sheet positioning button on the control panel. Then, the controller 400 starts to drive the forward rotation of the drive motor for the sheet feed cassette 41 and causes to perform same processing of sheet positioning and count processing in the manual tray 60. According to this, the sheet bundle placed inside the sheet feed cassette 41 is subjected to the positional alignment at the position of the center line L2.

In the place of automatically performing the positioning of the recording sheet by slidably moving the two side fences in the conveyance perpendicular direction by driving the drive motor, following positioning is also possible. Specifically, the end fence 414 which is configured to slidably move in the conveyance direction of the recording sheet (i.e., arrow E direction or a direction reverse to the arrow E direction) is driven in the configuration similar to that of the side fence of the sheet feed cassette 41 of the copier according to the present embodiment. While the end fence 414 that contacts the trailing end of the recording sheet stacked in the cassette is being slidably moved toward the leading end, the recording sheet is slidably moved toward the front end of the cassette. Then, upon the front end of the recording sheet being struck against the front end wall of the cassette, the drive motor transmission to the end fence 414 is shut, so that the recording sheet is positioned at the struck position with the front end wall. In this case, it is preferred that the bottom plate of the sheet feed cassette 41 be bent so that the central portion of the recording sheet in the conveyance perpendicular direction is bent and that the end fence 414 contact the bent portion of the recording sheet.

As illustrated in FIG. 6, the original tray 200 as a sheet stacker for the ADF 2 includes a sheet positioning device with a structure identical to the manual tray 60. The sheet positioning device includes a first side fence 211 and a second side fence 212, both being capable of slidably moving in the conveyance perpendicular direction on the tray upper surface 200*a*, a sheet placement surface. Further, similarly to the manual tray 60, the sheet positioning device of the original tray 200 includes members for slidably moving the side fences such as a first rack gear 213, a second rack gear 214, a joint pinion gear 215, a drive limiter 216, a drive motor 217, and the like. Then, the first side fence 211 and the second side fence 212 is caused to slidably move toward the center line of the conveyance perpendicular direction based on the same principle as described in the sheet positioning device for the manual tray 60, so that the position of the recording sheet P placed on the tray upper surface 200*a* is adjusted at the center line position.

The ADF 2 stands by for a command from the user, in which a sheet feed roller 202 to convey the original sheet P from the tray upper surface 200*a* is largely spaced away from the tray upper surface 200*a* and the two side fences 211 and 212 on the tray upper surface 200*a* each are positioned at their own home positions. Then, when the user who has placed the original sheet P on the tray upper surface 200*a* presses down a copy start button, first, the two side fences are slidably moved so that the original sheet P is positioned at the center line position. Then, after the sheet feed roller 202 has been lowered to contact the original sheet P, the original sheet P is started to be conveyed.

In the copier according to the embodiment, the relay tray 209*b* as the sheet stacker in the ADF 2 also includes a sheet positioning device identical to that of the manual tray 60. The ADF 2 includes a first relay side fence and a second relay side fence, both being slidable movably disposed on the relay tray 209*b* in the conveyance perpendicular direction. In the normal copying operation, the both relay fences are evacuated at respective home positions. Then, when the original sheet P one side of which has been read while passing through the second contact glass 301 is reversed upside down to be passed through the second contact glass 301 again, following processing is performed. Specifically, first, the posture of the switching claw is changed so that the free end of the switching claw is lowered than the illustrated state, and then, two rollers of the relay roller pair 210 are forward-rotated for a predetermined time period. With this attitude, the original sheet P that has passed through the conveyance nip of the second conveyance roller pair 206 after being scanned is conveyed onto the relay tray 209*b*. Next, in a state in which the rotation drive of the relay roller pair 210 has been stopped, the upper roller of the two rollers of the relay roller pair 210 is lifted up and is separated from the lower roller. With this operation, the original sheet P that has been sandwiched between the conveyance nips of the relay roller pair 210 is let go. With this state, the first relay side fence and the second relay side fence are caused to slidably move toward the center line between two side fences on the relay tray 209*b*, and the original sheet P on the relay tray 209*b* is positioned at the center line position. Thereafter, after the upper roller of the relay roller pair 210 is lowered to a position to form a conveyance nip, the reverse rotation of the relay roller pair 210 is started to start again the conveyance of the original sheet P.

In addition, in the copier according to the embodiment, a relay tray 88 as a sheet stacker for the reverse conveyance device 89 includes a sheet positioning device with a structure identical to that of the manual tray 60. The relay tray 88 includes a first relay side fence and a second relay side fence, both being slidable movably disposed on the sheet placement surface thereof in the conveyance perpendicular direction. In the normal copying operation, the both relay fences are evacuated at respective home positions. In addition, the sheet feed roller 42 is evacuated at a position largely spaced away from the sheet placement surface of the relay tray 88. When in the duplex printing mode, all the recording sheet 6 one side of which has been printed is stacked inside the relay tray 88, the first relay side fence and the second relay side fence of the relay tray 88 are slidably moved toward the center line in the conveyance perpendicular direction, so that the position of the recording sheet 6 stacked inside the relay tray 88 is adjusted at the center line position. Then, the sheet feed roller 42 is lowered so as to contact the recording sheet 6 inside the relay tray 88, and thereafter, the sheet feed roller 42 is driven to rotate. Because the recording sheet 6 inside the relay tray 88 has been positioned and is again conveyed from the relay tray 88 to the registration roller pair 45, occurrence of sheet jams and skews can be prevented.

In the copier according to the embodiment, the sheet discharge tray 80 serving as a sheet stacker in the image forming unit 4 includes a sheet positioning device identical to that of the manual tray 60. The sheet discharge tray 80 includes a first discharge side fence and a second discharge side fence, both being slidable movably disposed on the sheet placement surface thereof in the conveyance perpendicular direction. In the normal copying operation, the discharge side fences each are evacuated at each home position. When the continuous print job by the image forming unit 4 has been completed and all the recording sheets 6 are stacked on the sheet discharge tray 80, the first discharge side fence and the second discharge side fence of the sheet discharge tray 80 are slidably moved toward the center line in the conveyance perpendicular direction, so that the position of the recording sheet 6 stacked on the sheet discharge tray 80 is adjusted at the center line position.

In addition, the sheet discharge tray 80 can be connected to a post processor. The post processor includes at least one of the processing as specified below: Specifically, a stapling process to staple the recording sheet P on which an image has been formed thereon by the image forming unit 4; a classifying process to classify the recording sheet P on which the image has been formed depending on the addressee; an alignment process to align the leading end of the sheet or correct a skew of the sheet; and a sort process to rearrange the plurality of original sheets P in the sequential order of the page number. The post processor performing any of the above processes can incorporated the sheet positioning device according to the present embodiment of the invention. In the stapling process, the plurality of recording sheets 6 can be subjected to the positional alignment before the stapling process. Alternatively, positioning can be performed to the plurality of sets of sheet bundles which have been stapled and stacked in layers. In the former case, because the plurality of recording sheets 6 are stapled after having been positioned properly and stapled in a state without any misalignment, a sheet bundle without any misalignment can be obtained. In addition, in the latter case, the plurality of sets of sheet bundles can be piled up without any misalignment.

As aforementioned, the copier according to the present embodiment includes a plurality of detection levers 661, each of which has a tip end to contact the recording sheet formed in a tapered shape in the conveyance perpendicular direction. With such a structure, even though the recording sheet 6 is placed in an incomplete status in which the leading end of the sheet does not properly contact the contact case 61*a*, the recording sheet 6 is prevented from getting stuck with the detection lever 661.

In addition, in the copier according to the present embodiment, each of the plurality of detection levers 661 each are disposed to contact a leading end of the recording sheet in the conveyance direction placed on the placement surface of the first stacker 61 at the first position halted by the contact to the bottom plate of the first stacker 61. In such a structure, the leading end of the recording sheet 6 is caused to contact the detection lever 661 and the recording sheet 6 can be detected by the sheet sensor unit 66.

In addition, in the copier according to the present embodiment, the first stacker 61 includes a placement surface formed to have a slanted surface descending from upstream to downstream of the sheet conveyance direction. Then, because the leading end of the recording sheet 6 placed on the placement surface is press-contacted to the contact case 61*a* by its own weight along the slanted surface, the detection lever 661 contacting the leading end of the sheet can be securely evacuated to the second position.

Further, in the copier according to the present embodiment, a joint member is constructed with the swing shaft 662 pivotally moving about the swing shaft extending in the conveyance perpendicular direction, and the plurality of detection levers 661 each are connected to the swing shaft 662 so as to integrally move with the swing shaft 662. Further, the detection lever 661 is restricted to the second position against a biasing force from the coil spring 665 by a friction force with the recording sheet 6 being conveyed from the placement surface of the first stacker 61. In such a structure, until all the recording sheets 6 stacked on the placement surface in overlaid manner are completely conveyed from the placement surface, the sheet sensor unit 66 continues to detect the recording sheet 6.

In addition, in the copier according to the present embodiment, distances (L1, L2, and L3) between adjacent detection levers 661 with each other along the conveyance perpendicular direction is made to be shorter than the shorter side length (83 mm) of the printable minimum-sized sheet (i.e., the E-sized photo sheet) determined as a design standard. In a state in which the first side fence 611 and the second side fence 612 are maximally separated from each other in the conveyance perpendicular direction, the distance between the first side fence 611 and the detection lever 661 which is nearest to the first side fence 611, and the distance between the second side fence 612 and the detection lever 661 which is nearest to the second side fence 612 each are shorter than the above shorter side length. With such a structure, even though the recording sheet having a width equal to or larger than the minimum-sized sheet is placed at any place on the sheet placement surface of the manual tray 60, the leading end of the sheet contacts any of the detection levers 661 and the mutual contact can be detected by the sheet sensor unit 66.

In the copier according to the present embodiment, the sheet positioning device serves as a stopper to stop the first side fence 611 and the second side fence 612 both moving toward the recording sheet 6 in the conveyance perpendicular direction based on the fact that a load exceeding a predetermined threshold value is applied to the drive force transmission devices from the drive motor 617 as a drive source to the side fence. With this structure, the sheet positioning device stops slidable movement of the side fences when the size of the recording sheet 6 placed between the fences in the conveyance perpendicular direction substantially equals to the distance between the two side fences, whereby the recording sheet 6 can be corrected securely to have a straight posture along the conveyance direction. Further, bending of the recording sheet 6 caused from narrowing the distance between two side fences than the sheet size can be securely prevented and occurrence of the jams and skews of the recording sheet 6 can be adequately suppressed. In the copier according to the present embodiment, the sheet positioning device may be configured to stop the first side fence 611 and the second side fence 612 both moving toward the recording sheet 6 in the conveyance perpendicular direction based on the fact that a load exceeding a predetermined threshold value is applied to either of the first and second side fences.

In the copier according to the present embodiment, the home position sensor 650 is disposed, which is configured to detect whether the first side fence 611 is positioned at a home position being an evacuated position in the conveyance perpendicular direction when the recording sheet is placed on the placement surface of the manual tray, and the controller 400 executes processing to reversely drive the drive motor 617 until the first side fence 611 moves to the home position responsive to the command from the user. In such a structure, when the user places the recording sheet 6 on the sheet platen, the first side fence 611 and the second side fence 612 can be evacuated at each home position not disturbing the sheet placement.

In addition, in the copier according to the present embodiment, the bottom plate 610 serving as a proximal placement surface is postured to have an inclined angle θ with the sheet receiving surface 621 being a distal placement surface. Further, the first side fence 611 and the second side fence 612 are movably disposed along the conveyance perpendicular direction so as to contact at least the bent portion bending along the inclined angle θ among the entire area of the recording sheet placed on the sheet placement surface. With this structure, as aforementioned, even though only one sheet of normal recording paper is placed on the placement surface, while two side fences being halted at suitable positions, erroneous halting of the side fences due to the adhesion of dust can be prevented.

Additional modifications and variations of the present invention are possible in light of the above teachings. It is therefore to be understood that, within the scope of the appended claims, the invention may be practiced other than as specifically described herein.

What is claimed is:

1. A sheet positioning device comprising:

a platen on which to place a sheet of recording media;

a first regulation member disposed on the platen and movable along the platen in a first direction perpendicular to a sheet conveyance direction in which the sheet is conveyed, the first regulation member being configured to contact one end of the sheet placed on the platen from the first direction to regulate the position of the one end of the sheet;

a second regulation member to regulate the position of the other end of the sheet by contacting the other end of the sheet from a second direction opposite the first direction and perpendicular to the sheet conveyance direction, wherein, while the first regulation member regulates the position of the one end of the sheet, the second regulation member regulates the position of the other end of the sheet to position the sheet at a predetermined position on the platen in the first and second directions perpendicular to the sheet conveyance direction;

a drive source;

a drive transmitter to transmit a drive force generated by the drive source to at least the first regulation member to move the first regulation member in the first direction; and a sheet sensor unit comprising a plurality of sheet detection levers disposed along the conveyance perpendicular direction and reciprocally movable between a first position and a second position, a biasing member, and a connecting member that connects the plurality of sheet detection levers so that the entire sheet sensor unit moves as a single unit between the first position and the second position reciprocally, the sheet sensor unit detecting the sheet on the platen according to the position of the sheet detection levers moving from the first position to the second position while in contact with the sheet placed on the platen and in a state in which the plurality of sheet detection levers are being biased toward the first position by the biasing member.

2. The sheet positioning device as claimed in claim 1, wherein each of the plurality of sheet detection levers has a tapered tip end portion contacting the sheet.

3. The sheet positioning device as claimed in claim 1, wherein each of the plurality of sheet detection levers is disposed to contact a leading end of the sheet in the conveyance direction at the first position.

4. The sheet positioning device as claimed in claim 3, wherein the platen is inclined at a predetermined angle to the bottom of the sheet positioning device.

5. The sheet positioning device as claimed in claim 4, wherein the connecting member is a pivotable shaft configured to pivot about an axis extending in the first and second directions perpendicular to the sheet conveyance direction, and the plurality of sheet detection levers are connected to the connecting member so as to move integrally with the connecting member and are restrained at the second position against the biasing force of the biasing member by friction of contact with a sheet being sent from the platen.

6. The sheet positioning device as claimed in claim 1, wherein a distance between two adjacent sheet detection levers in the conveyance perpendicular direction is shorter than a length of a shorter side of a minimum-sized sheet that can be accommodate by the sheet positioning device, and, in a state in which the first regulation member and the second regulation member are retracted, a distance between the first regulation member and the sheet detection lever nearest the first regulation member and a distance between the second regulation member and the sheet detection lever nearest to the second regulation member are shorter than the shorter-side length of the minimum-sized sheet.

7. The sheet positioning device as claimed in claim 1, further comprising a drive limiter that stops the first regulation member from moving toward the sheet on the sheet platen in the first direction perpendicular to the sheet conveyance direction based on one of a load exceeding a predetermined threshold value applied to the drive source or the drive transmission unit and a pressure exceeding a predetermined threshold value applied to either the first regulation member or the second regulation member.

8. The sheet positioning device as claimed in claim 7, further comprising:

a home position sensor configured to detect whether the first regulation member is placed at a retracted position when the sheet is placed on the platen; and a drive controller to reversely drive the drive source until the first regulation member reaches the retracted position based on an input command.

9. The sheet positioning device as claimed in claim 7, further comprising a bottom plate forming a placement surface divided into a proximal placement surface on which to place the leading end side of the sheet and a distal placement surface on which to place a trailing end side of the sheet, wherein the distal placement surface is inclined at a predetermined angle with respect to the proximal placement surface, and the first regulation member and the second regulation member are movably disposed in the first and second directions perpendicular to the sheet conveyance direction so as to contact a curved portion of a sheet placed along the angle in the placement surface.

10. A sheet stacker comprising a sheet positioning device as claimed in claim 1.

11. An image forming apparatus comprising:

an image recording unit to record an image on a recording sheet;

a sheet stacker; and the sheet positioning device as claimed in claim 1.

12. An image scanner comprising:

an image reader to read an image recorded on an original sheet;

a sheet stacker; and the sheet positioning device as claimed in claim 1.

13. A sheet positioning device comprising:

a platen on which to place a sheet of recording media;

a first regulation member disposed on the platen and movable along the platen in a first direction perpendicular to a sheet conveyance direction in which the sheet is conveyed, the first regulation member being configured to contact one end of the sheet placed on the platen from the first direction to regulate the position of the one end of the sheet;

a second regulation member to regulate the position of the other end of the sheet by contacting the other end of the sheet from a second direction opposite the first direction and perpendicular to the sheet conveyance direction, wherein, while the first regulation member regulates the position of the one end of the sheet, the second regulation member regulates the position of the other end of the sheet to position the sheet at a predetermined position on the platen in the first and second directions perpendicular to the sheet conveyance direction;

a drive source;

a drive transmitter to transmit a drive force generated by the drive source to at least the first regulation member to move the first regulation member in the first direction; and a sheet sensor unit comprising a plurality of sheet contacting members disposed along the conveyance perpendicular direction and reciprocally movable between a first position and a second position and a connecting member that connects the plurality of sheet detection levers so that the entire sheet sensor unit moves as a single unit between the first position and the second position reciprocally, the sheet sensor unit detecting the sheet on the platen according to the position of the sheet detection levers moving from the first position to the second position while in contact with the sheet placed on the platen.

14. The sheet positioning device as claimed in claim 13, wherein each of the plurality of sheet detection levers is disposed to contact a leading end of the sheet in the conveyance direction at the first position.

15. The sheet positioning device as claimed in claim 14, wherein the platen is inclined at a predetermined angle to the bottom of the sheet positioning device.

16. The sheet positioning device as claimed in claim 13, wherein a distance between two adjacent sheet detection levers in the conveyance perpendicular direction is shorter than a length of a shorter side of a minimum-sized sheet that can be accommodate by the sheet positioning device, and, in a state in which the first regulation member and the second regulation member are retracted, a distance between the first regulation member and the sheet detection lever nearest the first regulation member and a distance between the second regulation member and the sheet detection lever nearest to the second regulation member are shorter than the shorter-side length of the minimum-sized sheet.

17. The sheet positioning device as claimed in claim 13, further comprising a drive limiter that stops the first regulation member from moving toward the sheet on the sheet platen in the first direction perpendicular to the sheet conveyance direction based on one of a load exceeding a predetermined threshold value applied to the drive source or the drive transmission unit and a pressure exceeding a predetermined threshold value applied to either the first regulation member or the second regulation member.

18. A sheet stacker comprising a sheet positioning device as claimed in claim 13.

19. An image forming apparatus comprising:

an image recording unit to record an image on a recording sheet;

a sheet stacker; and the sheet positioning device as claimed in claim 13.

20. An image scanner comprising:

an image reader to read an image recorded on an original sheet;

a sheet stacker; and the sheet positioning device as claimed in claim 13.

* * * * *